US007142178B2

(12) United States Patent
Aoki et al.

(10) Patent No.: US 7,142,178 B2
(45) Date of Patent: Nov. 28, 2006

(54) DRIVING DEVICE AND IMAGE DISPLAY APPARATUS

(75) Inventors: Tadashi Aoki, Kanagawa (JP); Aoji Isono, Kanagawa (JP); Kazuhiko Murayama, Kanagawa (JP); Kenji Shino, Kanagawa (JP); Yasuhiko Sano, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 319 days.

(21) Appl. No.: 10/459,434

(22) Filed: Jun. 12, 2003

(65) Prior Publication Data

US 2004/0032405 A1 Feb. 19, 2004

(30) Foreign Application Priority Data

Jun. 13, 2002 (JP) ..... 2002-172752

(51) Int. Cl.
*G09G 3/30* (2006.01)

(52) U.S. Cl. ..... 345/76; 345/77; 345/78; 345/81

(58) Field of Classification Search ..... 345/75.2, 345/74.1, 55, 100, 84, 204, 211, 102, 89, 345/108, 98, 97, 60, 76, 63, 69, 94, 589; 315/169.1–3, 366; 313/495, 496, 422, 582; 445/50, 24

See application file for complete search history.

(56) References Cited

U.S. PATENT DOCUMENTS 4,504,852 A * 3/1985 Ducret ..... 348/458
4,980,613 A * 12/1990 Miyama et al. ..... 315/366
5,066,883 A 11/1991 Yoshioka et al. ..... 313/309
5,202,609 A * 4/1993 Tomii et al. ..... 315/366
5,262,698 A * 11/1993 Dunham ..... 315/169.1
5,555,000 A 9/1996 Sarrasin et al. ..... 345/75
5,754,154 A * 5/1998 Katakura et al. ..... 345/97
5,977,940 A * 11/1999 Akiyama et al. ..... 345/94
6,169,356 B1 1/2001 Ohnishi et al. ..... 313/495
6,211,853 B1 * 4/2001 Takeuchi et al. ..... 345/108

(Continued)

FOREIGN PATENT DOCUMENTS

JP 7-181917 7/1995

(Continued)

OTHER PUBLICATIONS

C.A. Spindt, et al., "Physical Properties of Thin-Film Field Emission Cathodes with Molybdenum Cones", Journal of Applied Physics, vol. 47, No. 12, pp. 5248-5263 (Dec. 1976).

(Continued)

*Primary Examiner*—Bipin Shalwala
*Assistant Examiner*—Prabodh Dharia
(74) *Attorney, Agent, or Firm*—Fitzpatrick, Cella, Harper & Scinto

(57) ABSTRACT

A modulator includes a modulation circuit for generating modulation signals based on inputted luminance data and for outputting the modulation signals to a plurality of image display elements, each of which is driven by a potential difference between a selection potential applied within a predetermined time period by a selection circuit and the modulation signal. The modulation signal has a waveform which is a combination of a plurality of unit pulses, with the unit pulses having an identical width and n kinds of peak values A1 to An, with n being an integer greater than 1, and A1<. . . <An. Additionally, the unit pulses are combined in such a way that maximal peak value portions of the waveform of the modulation signal are dispersed, and that a rising portion and a falling portion of the waveform have a stair-step-like shape.

4 Claims, 35 Drawing Sheets

U.S. PATENT DOCUMENTS

| | | | | |
|---|---|---|---|---|
| 6,225,749 | B1 * | 5/2001 | Kobayashi et al. | 315/169.3 |
| 6,246,178 | B1 | 6/2001 | Isono | 315/169.3 |
| 6,323,833 | B1 * | 11/2001 | Takeuchi et al. | 345/84 |
| 6,339,429 | B1 * | 1/2002 | Schug | 345/589 |
| 6,414,669 | B1 * | 7/2002 | Masazumi | 345/98 |
| 6,426,588 | B1 * | 7/2002 | Yanagisawa | 313/422 |
| 6,445,367 | B1 * | 9/2002 | Suzuki et al. | 345/75.2 |
| 6,506,087 | B1 * | 1/2003 | Fushimi et al. | 445/24 |
| 6,611,099 | B1 * | 8/2003 | Murata et al. | 313/582 |
| 6,653,993 | B1 * | 11/2003 | Nagao et al. | 345/60 |
| 6,677,706 | B1 * | 1/2004 | Hara et al. | 313/496 |
| 6,879,096 | B1 * | 4/2005 | Miyazaki et al. | 313/495 |
| 7,068,244 | B1 * | 6/2006 | Nagao et al. | 345/60 |
| 2002/0151247 | A1 * | 10/2002 | Yanagisawa | 445/50 |
| 2002/0171608 | A1 * | 11/2002 | Kanai et al. | 345/55 |
| 2003/0107542 | A1 * | 6/2003 | Abe et al. | 345/89 |
| 2004/0001039 | A1 * | 1/2004 | Shino et al. | 345/100 |
| 2005/0078061 | A1 * | 4/2005 | Kim et al. | 345/63 |

FOREIGN PATENT DOCUMENTS

| | | |
|---|---|---|
| JP | 9-297556 | 11/1997 |
| JP | 11-18024 | 1/1999 |
| JP | 11-288247 | 10/1999 |

OTHER PUBLICATIONS

C.A. Mead, "Operation of Tunnel-Emission Devices", Journal of Applied Physics, vol. 32, No. 4, pp. 646-652 (Apr. 1961).

* cited by examiner

DRIVING DEVICE AND IMAGE DISPLAY APPARATUS

BACKGROUND OF THE INVENTION

1. Field of the Invention

The present invention relates to driving devices for driving image display elements by use of modulation pulses as modulated based on luminance data. More particularly but not exclusively, this invention relates to driving devices adaptable for use in image display apparatus equipped with an image display unit having a plurality of image display elements wired together into a matrix.

2. Description of the Related Art

Image display apparatus using image display elements including electron emitting elements and electro-luminescent (EL) elements has been studied. This type of image display apparatus is more excellent in characteristics than other types of conventional image display apparatus; so, the demand therefor is expected to rise in near future. For instance, the image display apparatus is advantageous over recently widely used liquid crystal display (LCD) devices in that the former requires no back-light units because of self-luminous type, and also in that the former is wider in viewing angles than the latter.

FIG. 28 indicates schematically one example of a multiple-electron source unit using electrical wiring methods. This multi-electron source unit is arranged to include a number of electron emitting elements which are laid out two-dimensionally so that these are electrically wired to have a matrix form as shown in the drawing.

In FIG. 28, reference numeral "1"designates electron emitting elements which are represented by symbols; numeral 2 denotes row wirings; 3 shows column wirings. The row wirings 2 and column wirings 3 have electrical wiring resistance 4, 5, wiring inductance 6, 7, and wiring capacitance 8. Numeral 9 denotes a scanning circuit; 10 is a modulator circuit; 11, a multi-electron source substrate; 12, a substrate.

In the multi-electron source unit with the matrix-wired electron emitting elements, appropriate electrical signals are applied to row and column wirings in order to output a desired electron beam.

FIG. 29 is a schematic waveform diagram for explanation of a pulse width modulation (PWM) scheme. For example, in order to drive any given row of electron emitting elements in the matrix, a selection potential Vs is applied to a row wiring of a presently selected row and a non-selection potential Vns, at the same time, is applied to row wirings of non-selected rows. In a way synchronous with this voltage application, a drive potential (modulation pulse signal) Ve is applied to a column wiring for output of an electron beam.

With this method, a voltage of Ve–Vs is applied to an electron emitting element in the selected row, while a voltage with a potential Ve–Vns is applied to an electron emitting elements in the non-selected rows. Setting the voltages Ve, Vs and Vns at appropriate potential levels enables an electron beam with a desired intensity to be output from only the electron emitting element or elements in the selected row. Additionally in view of the fact that cold cathode elements are inherently high in speed of response, adequately varying the length of a time period for application of the drive potential Ve makes it possible to change the length of a time period for electron beam output.

Similar electron beam controllabilities may also be achieved by other techniques such as pulse wave peak value modulation schemes, also known as pulse height modulation (PHM), which control the luminance by changing the potential level (amplitude) and/or current value of a modulation pulse being applied to a column wiring.

Unfortunately, currently available large-screen high-definition image display apparatus with enhanced fidelity and increased resolution capability—such as displays with 1,920 by 1,080 dots of effective pixels and a frame rate of 60 hertz (Hz) and also 10-bit gradation tonality—are encountered with problems which follow.

Letting the wave height or peak value of an energy applied to an element in pulse peak value modulation schemes be Pi, the above-noted image display apparatus requires a resolution of $Pi/2^{10}=Pi/1024$. Pi is set at several volts (V) in the case of voltage driving and, therefore, a resolution of several millivolts (mV) is required for a drive waveform over the entirety of a display screen with 1,920-by-1,080 pixels. However, in view of electrical characteristics of components making up drive circuitry such as integrated circuit (IC) chips and printed wiring boards and power supply units, it remains difficult to achieve such level of resolution.

On the other hand, in the case of pulse width modulation schemes, a time taken to drive a single scan line is $1/(60\times1080)$ sec, which is nearly equal to 15 microseconds (μsec). In case 10-bit pulse width modulation is performed, the minimum pulse width is $1/(60\times1080\times2^{10})$ sec. which is about to 15 nanoseconds (nsec). In this case the pulse width resolution of 15 nsec in minimum is required.

However, the wirings as shown in FIG. 28 are equivalent to low-pass filters having a cut-off frequency that is determined by the wire inductance (L), wire capacitance (C) and wire resistance (R). Accordingly, in the case of driving signal transmission wirings and/or display unit wirings having such low-pass characteristics by line-sequential pulse width modulation (PWM) drive schemes with frequency spectrum components higher than or equal to the cutoff frequency, PWM waveforms being applied to elements can experience unwanted rounding of the rising and falling rectangular edges thereof as shown in FIG. 30. This wave edge rounding would result in a decrease in display quality at low luminance levels.

In particular, in case a PWM drive waveform with low gradation is applied from the modulator circuit 10, a synthetic waveform that is created by combination of a drive waveform and an output waveform of the scanning circuit 9 and is applied to an electron emitting element 1 decreases in peak value. This leads to a decrease in peak value of a drive waveform that is made up of high frequency spectrum components only, that is, the low-gradation PWM drive waveform. In other words, it is no longer achievable to visually display any image with desired tonality in low gradation regions.

Also note that in the case of supplying constant current pulses with short time lengths from a control constant current source to a multi-electron source unit with a very large number of matrix-wired electron emitting elements, a problem that electrons are hardly released in any way arises. Obviously, electrons are emitted in case constant current pulses are continuously supplied within a relatively long time period; however, a lengthened rise-up time must be required until initiation of electron emission.

FIG. 30 is a timing chart for explanation of the problems above. As shown herein, when merely supplying short current pulses from the control constant current source, a drive current If hardly flows in any electron emitting element. Even when supplying long pulses, the drive current If flowing in the electron emitting element comes to have a waveform with an increased rise-up time. This occurs due to some rounding of rectangular-wave edges of the current waveform being fed to the electron emitting element. More specifically, the current waveform can experience such edge rounding in spite of the fact that the cold cathode type electron emitting element per se has high-speed response performance. Such waveform rounding results in deformation or distortion of the waveform of an emission current Ie.

In multi-electron source unit with passive matrix-wired electron emitting elements, the parasitic capacitance (wiring capacitance) increases with an increase in matrix scale or size. Main part of the parasitic capacitance is present at an intersection between row and column wirings. An equivalent circuit of this is shown in FIG. 28. When beginning supply of a constant current I1 from the modulator circuit 10 for use as the control constant current source that is connected to column wirings 3, this current is consumed for charge-up of the individual parasitic capacitance 8 early in the time period and thus hardly acts as the drive current of an electron emitting element or elements 1. Due to this, an appreciable decrease takes place in effective response speed of the electron emitting element(s).

Additionally the voltage drive schemes are faced with problems to be solved as follows. Image display apparatus using light emitting elements of the type causing a current to flow during driving—for example, light-emitting diodes (LEDs), electroluminescence (EL) devices, field emission display (FED) elements, surface-conduction electron-emitter display (SED) elements—is generally designed so that the wiring resistance is set lower in value. Accordingly its equivalent circuitry is given as the model shown in FIG. 28, which comes with the parasitic capacitance, resistance, and inductance components. When applying the related art voltage drive method to such circuitry, a drive waveform experiences some rounding of rising edges due to the flow of a charge-up current i into the parasitic capacitance upon application of a voltage. Furthermore, owing to the self-inductive action of the parasitic inductance, an electromotive force of $U=-L\times(di/dt)$ is produced resulting in generation of over-shooting and/or ringing, which leads to unwanted occurrence of application of abnormal voltages to light emitting elements.

In recent years, image display apparatus is under growing requirements for achievement of larger screen sizes and higher precision and also higher gradation. The quest for larger screen sizes and higher precision and higher tonality results in increases in parasitic inductance and capacitance of electrical wires used. Hence, the problems such as the failure of tonality in dark regions due to the rounding of rising edge of the drive waveform, the overshoot and the ringing are becoming more serious issues to be solved.

Another problem of the approach using drive waveforms created by means of plain pulse width control and pulse peak value control schemes is that uniform increasing characteristic of the grayscale/gradation tonality is no longer guaranteeable due to any possible changes and fluctuations of the voltage versus luminescence intensity characteristics of light emitting elements.

In addition, drive waveforms based on the simple pulse width control are such that their pulses are made identical in start timing as shown in FIG. 31. With such aligned pulses, a large current rushes to flow in a scan wiring at the time of potential rise-up of a pulse width modulation waveform, resulting in occurrence of a voltage drop. In a multi-electron source unit with a great number of matrix-wired electron emitting elements, the voltage to be applied to each element decreases due to the voltage drop occurring by the influence of the resistance component of such wiring. The greater the distance from its power supply end, the lower the element-applied voltage. A result of this is that the emission electron distribution pattern of each element fails to stay uniform. And,when applying such multi-electron source unit to image display apparatus, a problem arises that the display quality can decrease due to the voltage drop as created by the wiring resistance.

An explanation will be given of the voltage drop with reference to FIG. 28 and FIG. 32. FIG. 32 is a perspective view of an image display panel using the multi-electron source substrate 11 of FIG. 28. In FIG. 32, numeral 13 designates a metal back plate; 14 denotes a fluorescent layer; 15 is a front face plate.

Now suppose that a row wiring 2 is selected. Assume that all of the pixels connected to the selected row wiring 2 are driven to turn on. An equivalent circuit at this time is shown in FIG. 33. In this drawing, 16 denotes current components flowing into the row wiring 2 from its associated column wirings through corresponding electron emitting elements; 4 indicates resistance components of row wiring 2.

Here, assume that the currents flowing into the row wiring 2 measure the same value If for respective elements. Also assume that the resistance value of row wiring 2 per pixel is rf. A voltage potential on the row wiring at this time is calculated in a way which follows.

A current which flows in a resistance component Rf5 is If. A voltage drop caused by Rf5 is given as If·rf. A current flowing in Rf4 is 2·If, and a voltage drop by Rf4 is 2·If·rf. Similar calculations are repeated to determine the voltage drop at each resistance component. Calculation results of the potential at each portion on the row wiring 2 are plotted in a graph of FIG. 34. Note here that the data plot in this graph is under an assumption that the drive potential Ve is higher than the selection potential Vs, i.e. Ve>Vs.

Remarkably, when the potential Vs is output from the scanning circuit 9 that is a power feed point, a current flows into the row wiring 2, resulting in an increase in potential with an increase in distance from the power feed point. Especially a potential increase at the farthest end is as large as 21·If·rf. FIG. 35A shows the waveform of a voltage signal which is applied to a row wiring; FIG. 35B shows a drive waveform that is applied to a row wiring at the farthest end; and, FIG. 35C is a voltage waveform as applied to a selected electron emitting element. It can be seen that the potential riseup causes the selection potential to change from Vs to Vs', resulting in a likewise decrease in element-applied voltage.

This voltage difference pauses no particular problems in case the row wiring stays less in resistance. However, such voltage difference is no longer negligible in some cases—for example, when the row wiring has an increased value of resistance due to an increase in screen size of image display apparatus. The voltage difference also becomes greater in cases where the pixels used increase in number resulting in an increase in current flowing into the row wiring.

This voltage difference causes electron emitting elements to differ from one another in voltage applied thereto. In particular, an electron emitting element near the power feed point and another element far therefrom are such that the same voltage is never applied thereto, resulting in occurrence of an appreciable difference therebetween in electron emission amount. This is observable as a luminance difference between pixels, which leads to a decrease in display quality.

SUMMARY OF THE INVENTION

The present invention has been made in view of the above technical background and a primary object of this invention is to provide a driving device capable of accurately driving image display elements in accordance with inputted luminance data. Another object of the invention is to provide an image display apparatus capable of displaying high fidelity images with enhanced picture quality.

In accordance with one aspect of the present invention, a driving device comprising: selection means to output within a predetermined time period a selection potential to a row wiring to which a plurality of image display elements connected; and modulation means to generate a modulation signal based on inputted luminance data and output the modulation signal to column wirings connected to the image display elements so that the image display elements are driven by a potential difference between the selection potential and the modulation signal.

In accordance with another aspect of this invention, an image display apparatus comprising: an image display unit including a plurality of image display elements matrix-wired by a plurality of row wirings and a plurality of column wirings; selection means to output within a predetermined time period a selection potential to a row wiring to which a plurality of image display elements connected; and modulation means to generate a modulation signal based on inputted luminance data and output the modulation signal to column wirings connected to the image display elements so that the image display elements are driven by a potential difference between the selection potential and the modulation signal.

In the invention, the modulation means is capable of outputting n kinds of unit pulses with an identical width and with peak values A1 to An (n is an integer greater than 1, and A1<. . . <An), controls the peak value and width of a modulation signal through changing the kind and the number of output unit pulses in accordance with the luminance data and makes unit pulses having a maximal peak value appear dispersedly within the predetermined time period in case of outputting more than one unit pulse with the maximal peak value out of unit pulses which comprise the modulation signal.

Preferably, the modulation means outputs a unit pulse with a peak value Ak (k is an integer greater than or equal to 2 and less than or equal to n) after it outputs all kinds of unit pulses with peak values of from A1 to Ak−1 sequentially, in case of outputting a waveform rising up to the peak value Ak.

At this time it is further preferable that a time which has taken for the waveform to start rising up and reach the peak value Ak is substantially equal to or longer than 0 to 90 percent (%) of a time constant.

Also preferably, the modulation means outputs all kinds of unit pulses with peak values of from Ak−1 to A1 sequentially following outputting a unit pulse with a peak value Ak (k is an integer greater than or equal to 2 and less than or equal to n), in case of outputting a waveform falling down from the peak value Ak.

It is also preferable that the modulation means has a plurality of dispersion rules of dispersing each unit pulse with the maximal peak value within the predetermined time period and divides the column wirings into a plurality of groups so that dispersion rules of respective groups are different from each other.

Preferably the image display element is an electron emitting element. More preferably it is a surface-conduction electron-emitting element.

DESCRIPTION OF THE PREFERRED EMBODIMENTS

Preferred embodiments of this invention will be explained in detail with reference to the accompanying drawings below. Note that the sizes, materials, shapes and relative layout positions of constituent parts or components of the embodiments as disclosed herein should not be interpreted to limit the scope of the invention unless otherwise specific notices are recited in the description.

(First Embodiment)

Figure 1:
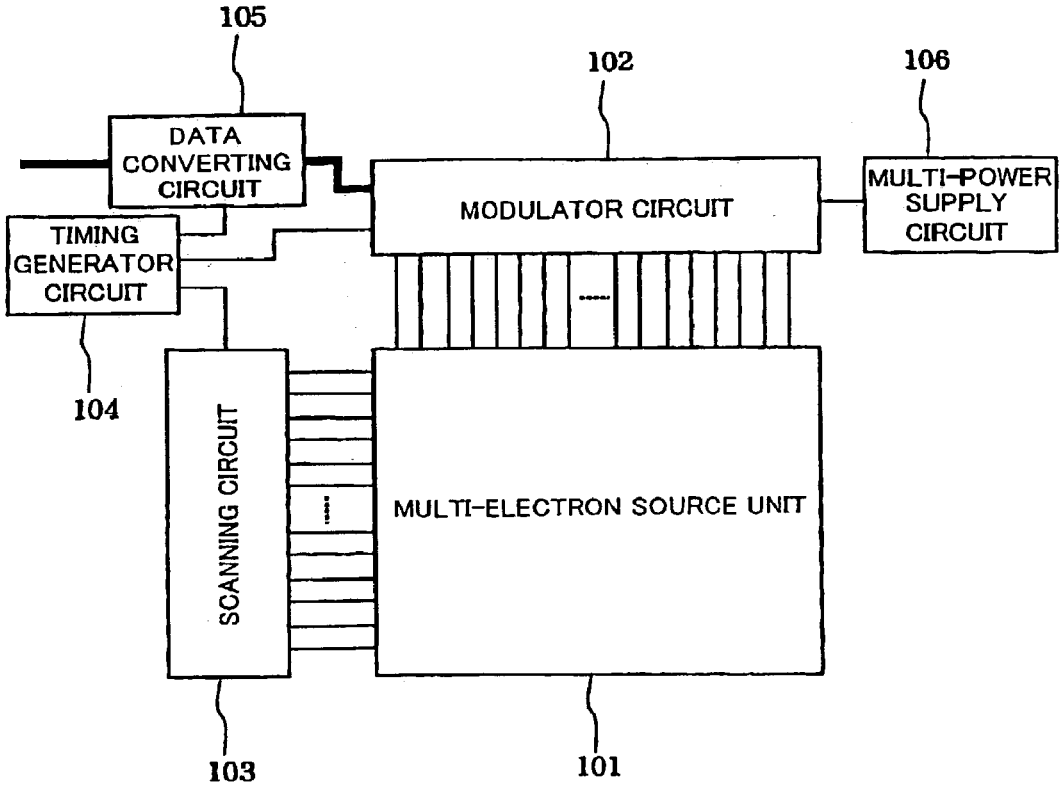
FIG. 1 is a block diagram of a driving device in accordance with a first embodiment of the present invention.

FIG. 1 illustrates, in schematic block diagram form, a driving device in accordance with a first embodiment of the invention. As shown herein, the driving device is arranged to have a modulator circuit (modulation means) 102, a scanning circuit (selection means) 103, a timing generator circuit 104, a data converting circuit 105, and a multiple-power supply circuit 106. This driving device is a circuit for driving a multiple-electron source unit 101, which makes up an image display module of image display apparatus.

Figure 28:
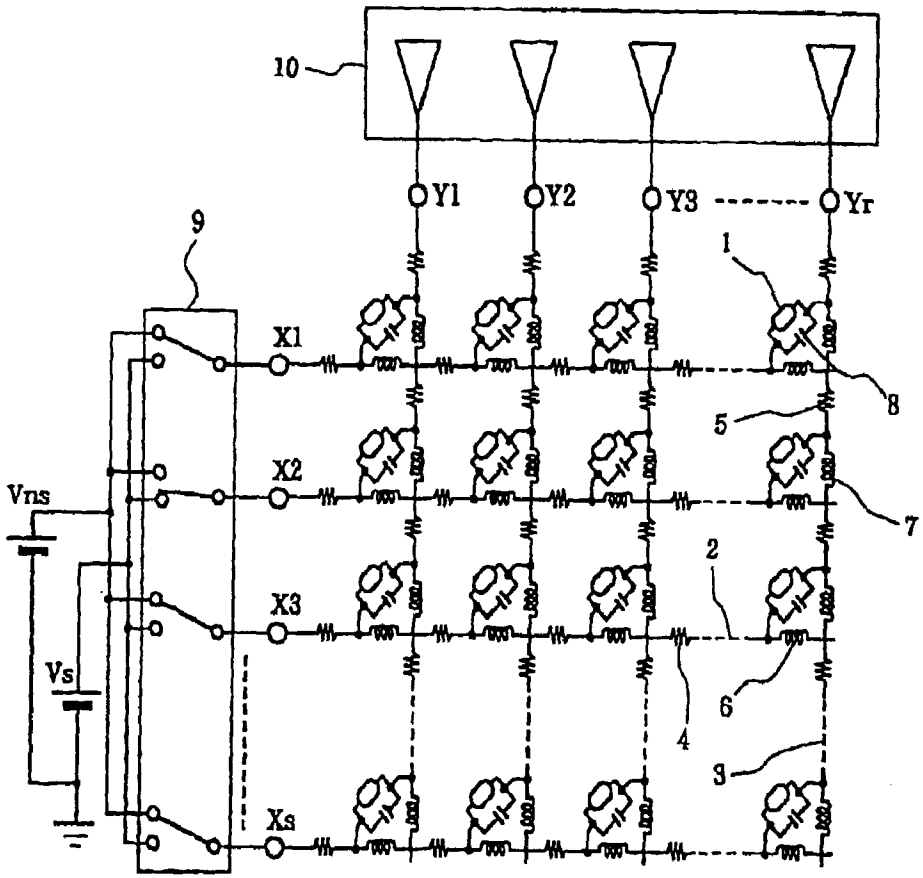
FIG. 28 (PRIOR ART)
FIG. 28 is a wiring diagram showing an electrical configuration of a multiple-electron source unit.
Figure 29:
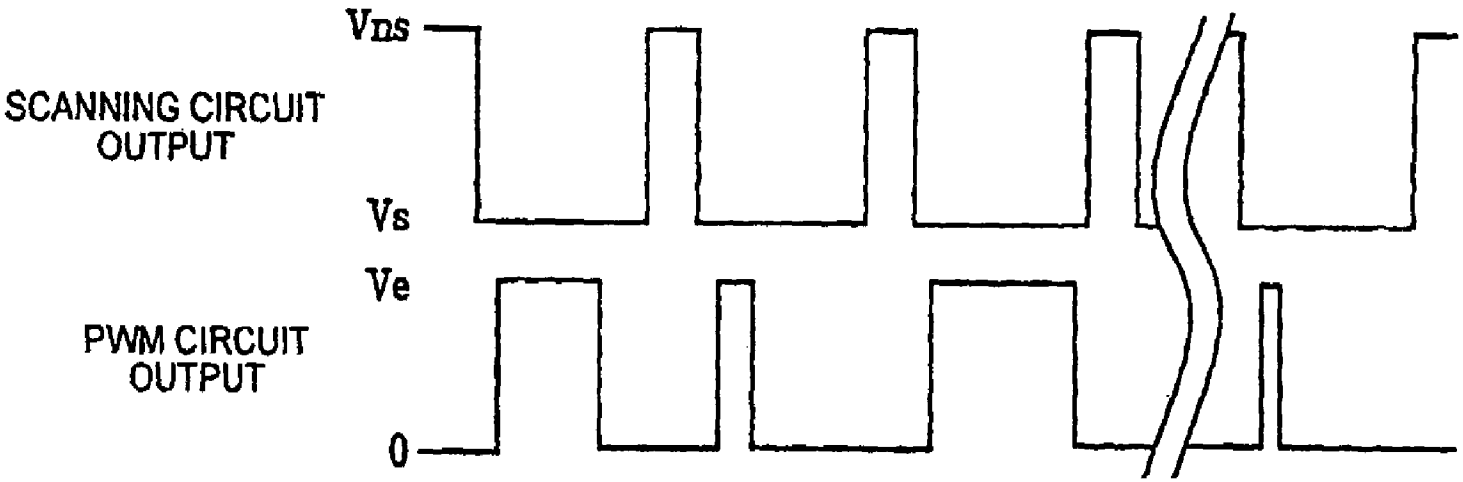
FIG. 29 (PRIOR ART)
FIG. 29 is a waveform diagram showing output signals of a scanning circuit and PWM circuit in the related art.
Figure 30:
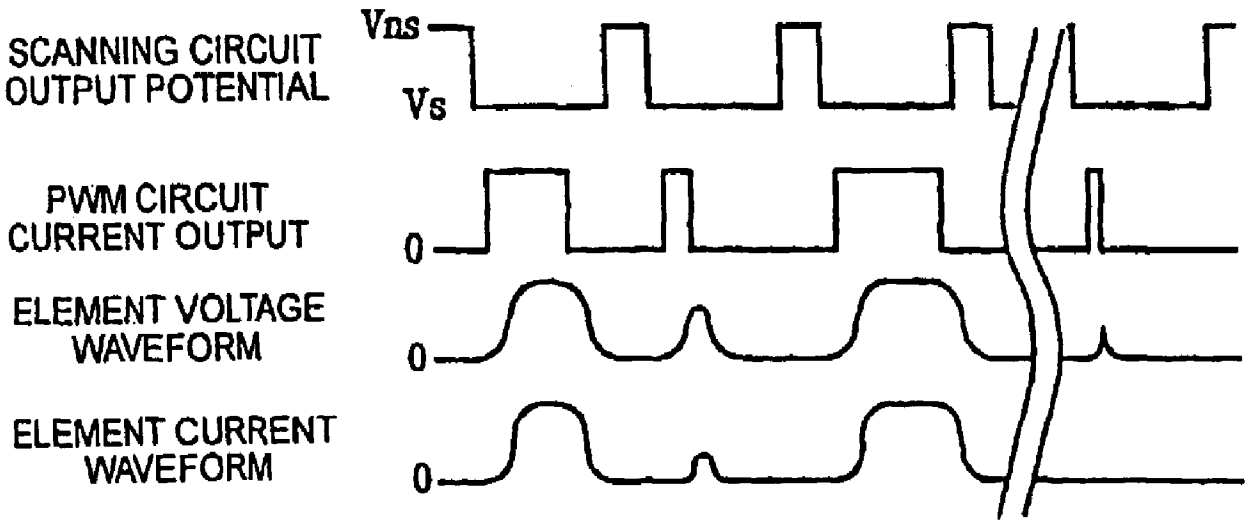
FIG. 30 (PRIOR ART)
FIG. 30 is a waveform diagram showing output signals of a scanning circuit and PWM circuit in the related art.
Figure 31A:
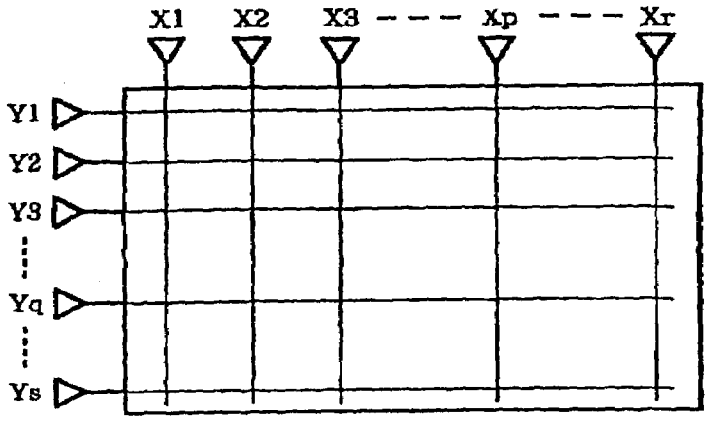
FIG. 31A (PRIOR ART)
FIGS. 31A and 31B are diagrams for explanation of a current flowing in a row wiring.
Figure 31B:
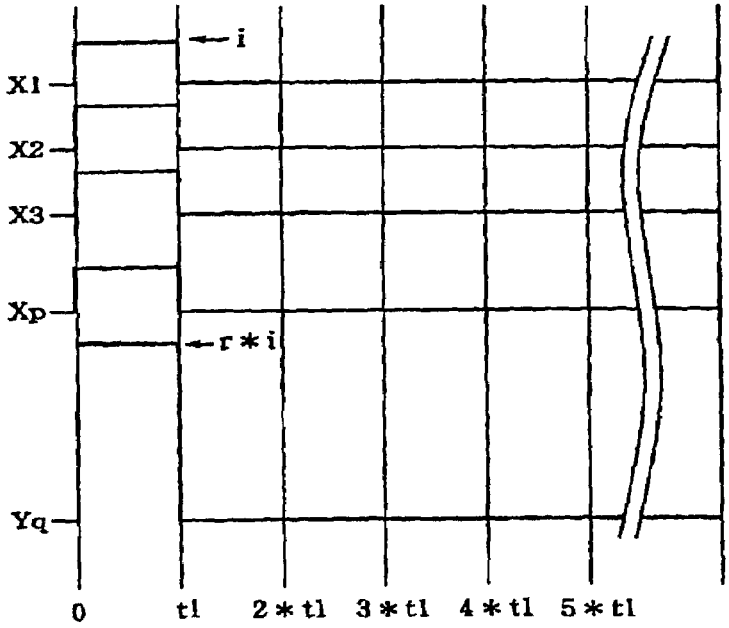
FIG. 31B (PRIOR ART)
Figure 32:
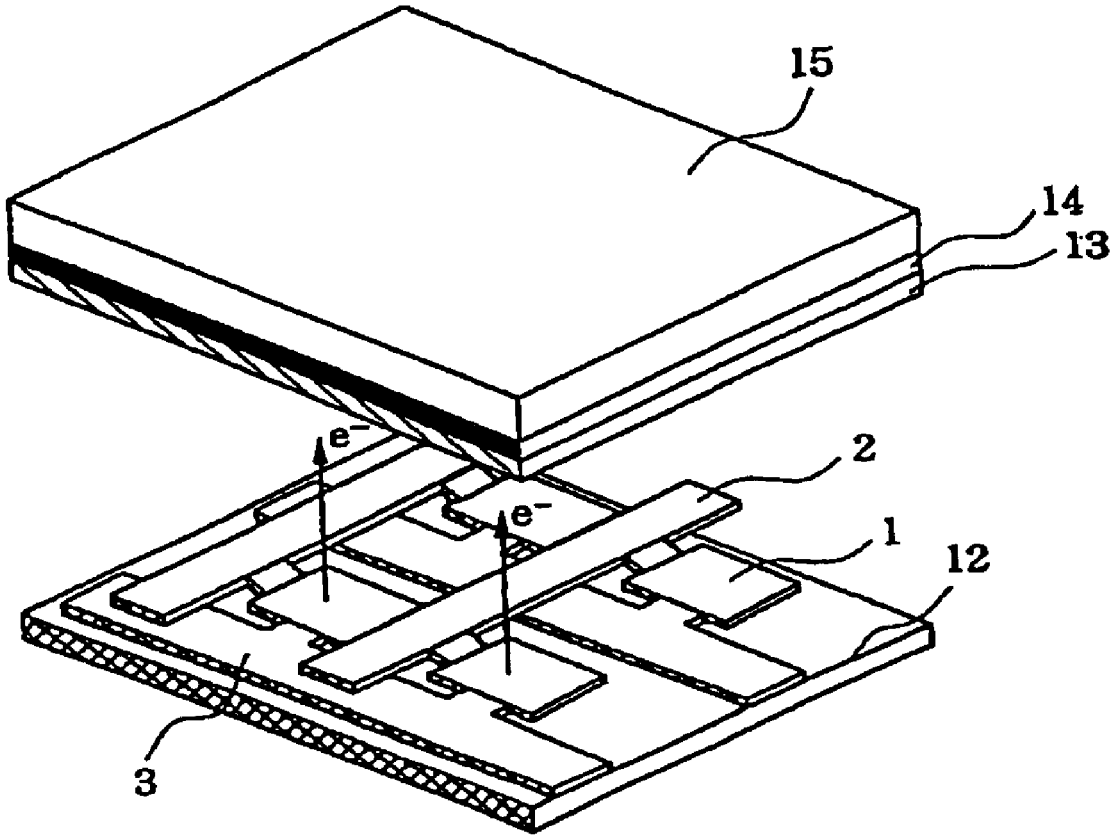
FIG. 32 (PRIOR ART)
FIG. 32 is an exploded perspective view of the multi-electron source unit of FIG. 28.
Figure 33:
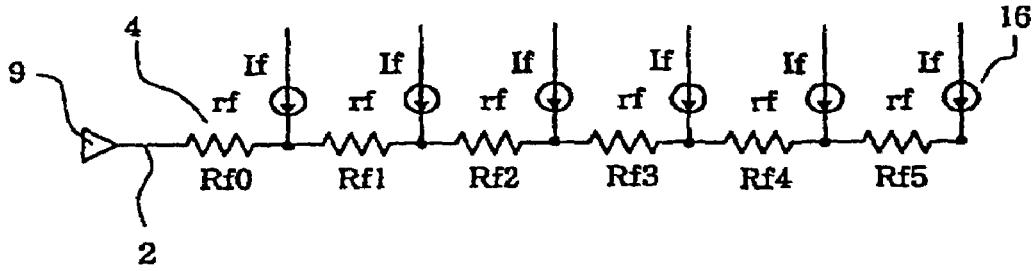
FIG. 33 (PRIOR ART)
FIG. 33 is a diagram showing an equivalent circuit when all of the pixels being connected to a given row wiring are driven to turn on concurrently.
Figure 34:
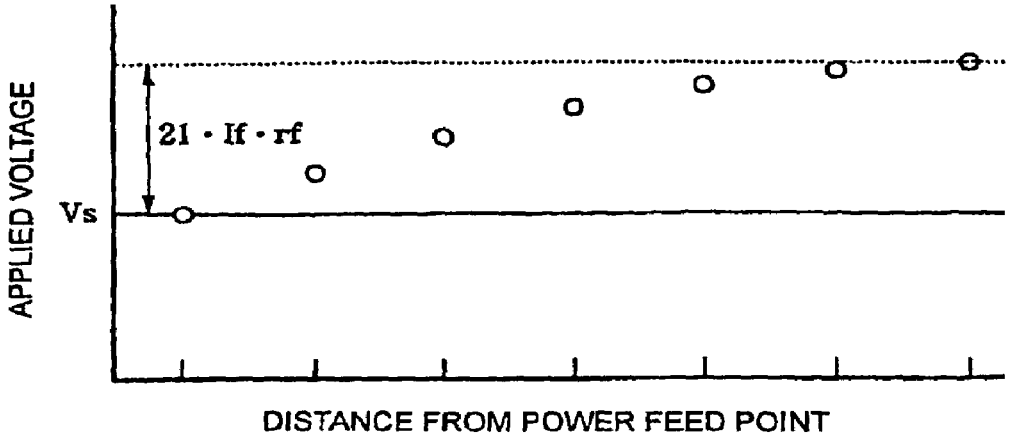
FIG. 34 (PRIOR ART)
FIG. 34 is a graph showing voltages at respective portions on a row wiring in the circuit of FIG. 33.
Figure 35A:
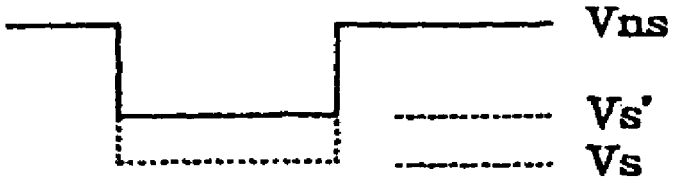
FIG. 35A (PRIOR ART)
FIG. 35A is a waveform diagram of a voltage which is applied to a row wiring in the circuit of FIG. 33.
Figure 35B:
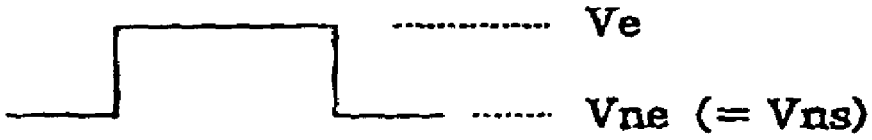
FIG. 35B is a waveform diagram of a drive voltage that is applied to a column wiring at the furthest end.
Figure 35C:
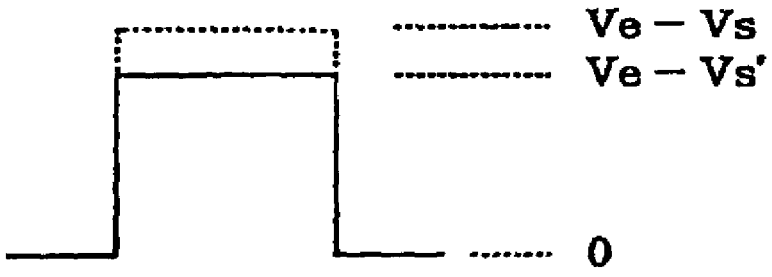
FIG. 35C is a waveform diagram of a voltage as applied to a presently selected electron emitting element.

The multi-electron source unit 101 is the one with electron sources (image display elements) 1 being disposed at cross points of row wirings 2 and column wirings 3 as shown in FIG. 28.

The electron sources may preferably be cold cathode elements. These cold cathode elements are capable of obtaining the intended electron emission at low temperatures when compared to hot cathode elements and, therefore, do not require any extra heaters for heat-up use. Accordingly, the cold cathode elements are simpler in structure than hot cathode elements, thus enabling fabrication of size-reduced or microstructural elements. In addition, even when a great number of elements are laid out together on a substrate, problems such as thermal fusion or hot melting of substrates hardly occur. Another advantage of the cold cathode elements over hot cathode elements is that the former is higher in response speed than the latter. More specifically, hot cathode elements operate under heat application by associative heaters so that their response speeds stay low. Unlike such hot cathode elements, cold cathode elements offer superior response speeds as these require no heaters to operate.

Known examples of the cold cathode elements include, but are not limited to, surface conduction emitting (SCE) elements, field emission (FE) elements, and metal/insulator/metal (MIM) emission elements.

The SCE elements use the phenomenon that electron emission takes place due to the flow of a current in a small-area thin-film as formed on a substrate in a direction parallel to a film surface. Typical examples of the SCE elements are disclosed in U.S. Pat. Nos. 5,066,883 and 6,169,356.

The SCE elements are less in structural complexity and easier in manufacture than the other types of cold cathode elements and, for the very reason, offer an advantage as to the capability to fabricate a great number of elements over a large area. In view of this, this embodiment is arranged to employ SCE elements for use as the electron source 1.

Optionally FE or MIM elements other than the SCE elements are preferably employable. Their structures will be explained in brief below.

A typical example of FE element structures is disclosed in C. A. Spindt, Physical properties of thin-film field emission cathodes with molybdenum cones, J. Appl. Phys., 47, 5248 (1976). Another exemplary FE element structure is available, which is designed so that an emitter and a gate electrode are disposed on a substrate in a direction almost parallel to the substrate surface, instead of the multilayered structure such as that taught by the above-identified article.

An example of MIM elements is found in C. A. Mead, Operation of tunnel-emission devices, J. Appl. Phys., 32, 646 (1961).

Turning back to FIG. 1, a configuration of the driving device will be set forth below.

The data converting circuit 105 is a circuit which receives externally input drive data for driving the multi-electron source unit 101 and then converts the drive data into data with a format adapted for use in the modulator circuit 102.

The modulator circuit 102 is a circuit, which is connected to the column wirings of the multi-electron source unit 101, for inputting a modulation signal to the multi-electron source unit 101 in accordance with modulation data (luminance data) which is inputted after data conversion by the data converting circuit 105. The modulator circuit 102 functions as the modulation means to generate the modulation signal based on the luminance data inputted from the data converting circuit 105 and output the modulation signal to column wirings connected to a plurality of electron sources respectively.

The scanning circuit 103 is a circuit, which is connected to the row wirings of the multi-electron source unit 101, for selecting one from among the rows of the multi-electron source unit 101, to which an output signal of the modulator circuit 102 is supplied. Although the scanning circuit 103 is generally designed to perform a line sequential scanning operation in a way that a single row is selected at a time, this design should not be interpreted as a limitative one and other approaches are available, including "many-at-a-time" selection and "area-at-once" selection schemes, wherein the former is for selecting more than two rows at a time whereas the latter is to select a block of elements in a selected area concurrently at a time. In view of this functionality the scanning circuit 103 functions as the selection means to output within a predetermined time period a selection potential to a row wiring to which a plurality of electron sources, drive targets selected from among the electron sources in the multi-electron source unit 101, connected thereby to select the row.

The timing generator circuit 104 is a circuit that generates timing signals for respective circuits of the modulator circuit 102, scanning circuit 103, and data converting circuit 105.

The multi-power supply circuit 106 is a power supply (PS) circuit which is operable to output a plurality of power supply values, for controlling an output value of the modulator circuit 102. Generally this is a voltage source circuit, although the invention is not limited thereto.

Figure 2:
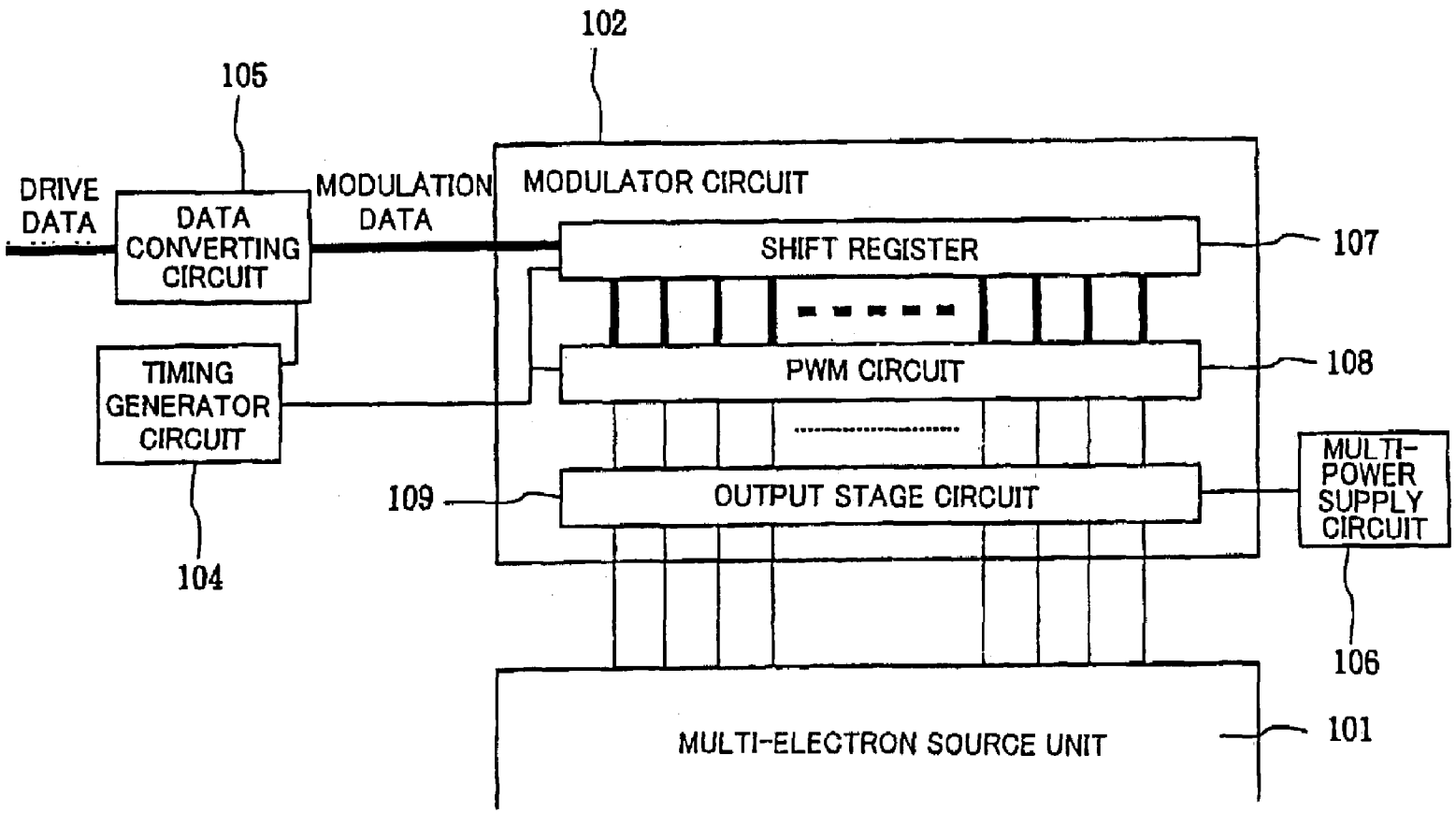
FIG. 2 is a block diagram of a modulator circuit in FIG. 1.

A detailed explanation will next be given of the modulator circuit 102 in conjunction with a block diagram of FIG. 2. FIG. 2 depicts in block form an internal configuration of the modulator circuit 102.

The modulator circuit 102 is configured from a shift register 107, a pulse width modulation (PWM) circuit 108, and an output stage circuit 109 operatively associated therewith.

The shift register 107 is provided to receive modulation data as input from the data converting circuit 105. The data is obtained through format conversion of drive data at data converting circuit 105. The shift register 107 is operable to transfer toward the PWM circuit 108 the modulation data corresponding to a column wiring(s) of the multi-electron source unit 101. The output stage circuit 109 is connected to the multi-power supply circuit 106, for outputting a modulation signal that has a drive waveform as will be discussed in detail later in the description. PWM circuit 108 receives, from shift register 107, input modulation data complying with the column wiring(s) of multi-electron source unit 101 and then generates an output signal pursuant to a respective output voltage of the output stage circuit 109. The timing signals used to control shift register 107 and PWM circuit 108 are input from the timing generator circuit 104.

Figure 3:
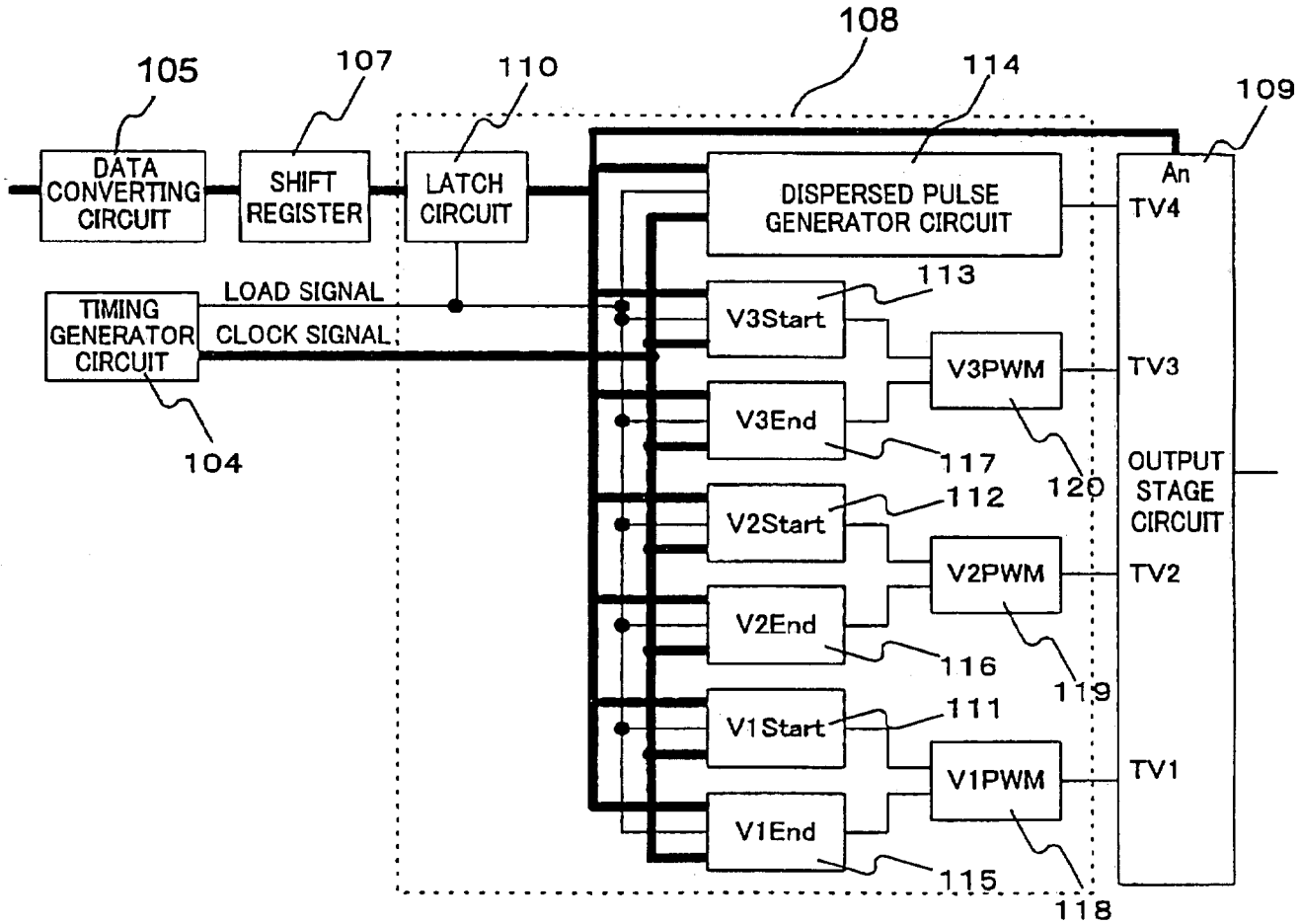
FIG. 3 is a block diagram of a pulse width modulation (PWM) circuit in FIG. 2.

A detailed explanation will be given of the PWM circuit 108 with reference to a block diagram of FIG. 3. FIG. 3 is a block diagram showing an internal configuration of the PWM circuit 108. Shown herein is a circuit portion that is provided per column wiring. It should be noted that although the explanation here is devoted to one specific case for output of four waveforms V1 to V4 by use of four stages of voltage output circuits, this is an illustrative example and should not be interpreted to limit the scope of the invention in any way.

The PWM circuit 108 is arranged including a latch circuit 110, a V1 start circuit 111, a V2 start circuit 112, a V3 start circuit 113, a dispersed pulse generator circuit 114, a V1 end circuit 115, a V2 end circuit 116, a V3 end circuit 117, a V1 PWM generator circuit 118, a V2 PWM generator circuit 119, and a V3 PWM generator circuit 120.

The latch circuit 110 is operable to receive each modulation data as output from each shift register 107 and latch the data therein in response to a load signal which is output from the timing generator circuit 104. Note here that the load signal as output from timing generator circuit 104 is also for use as a timing signal that permits start-up of each PWM signal.

The modulation data being presently latched in the latch circuit 110 is then input to the V1–V3 start circuits 111–113, V1–V3 end circuits 115–117 and dispersed pulse generator circuit 114.

Next, a start signal that is output from the V1 start circuit 111 and an end signal as output from the V1 end circuit 115 are input to the V1 PWM generator circuit 118 so that a PWM output waveform TV1 corresponding to the output voltage V1 is input to the output stage circuit 109. Similarly, a start signal that is output from the V2 start circuit 112 and an end signal as output from the V2 end circuit 116 are input to the V2 PWM generator circuit 119 so that a PWM output waveform TV2 corresponding to the output voltage V2 is input to the output stage circuit 109; a start signal being output from the V3 start circuit 113 and an end signal as output from the V3 end circuit 117 are input to the V3 PWM generator circuit 120 so that a PWM output waveform TV3 corresponding to the output voltage V3 is input to the output stage circuit 109.

The dispersed pulse generator circuit 114 is a dispersed pulse generation means for generating more than one dispersed pulse based on the latched modulation data. The dispersed pulse is input as a PWM output waveform TV4 to the output stage circuit 109. Here, the "dispersed pulse" is a pulse having a waveform obtained by combination of a plurality of unit pulses which have a specified width and appear dispersedly within a predetermined time period.

Here, in order to produce a modulation signal that has its drive waveform as will be described later, the start signal which is output from the V2 start circuit 112 is output at a later timing than the start signal that is output from the V1 start circuit 111. For the same purpose, the start signal that is output from the V3 start circuit 113 is output at a later timing than the start signal that is output from the V2 start circuit 112; the startup of the waveform as output from the dispersed pulse generator circuit 114 is output at a later timing than the start signal that is output from the V3 start circuit 113.

Furthermore, the end signal that is output from the V3 end circuit 117 is output at a later timing than the termination of the waveform that is output from the dispersed pulse generator circuit 114; the end signal that is output from the V2 end circuit 116 is output at a later-timing than the end signal that is output from the V3 end circuit 117; and, the end signal that is output from the V1 end circuit 115 is output at a later timing than the end signal as output from the V2 end circuit 116.

A detailed explanation will next be given of the V1–V3 start circuits 111–113, the V1–V3 end circuits 115–117 and the V1–V3 PWM generator circuits 118–120.

Figure 4:
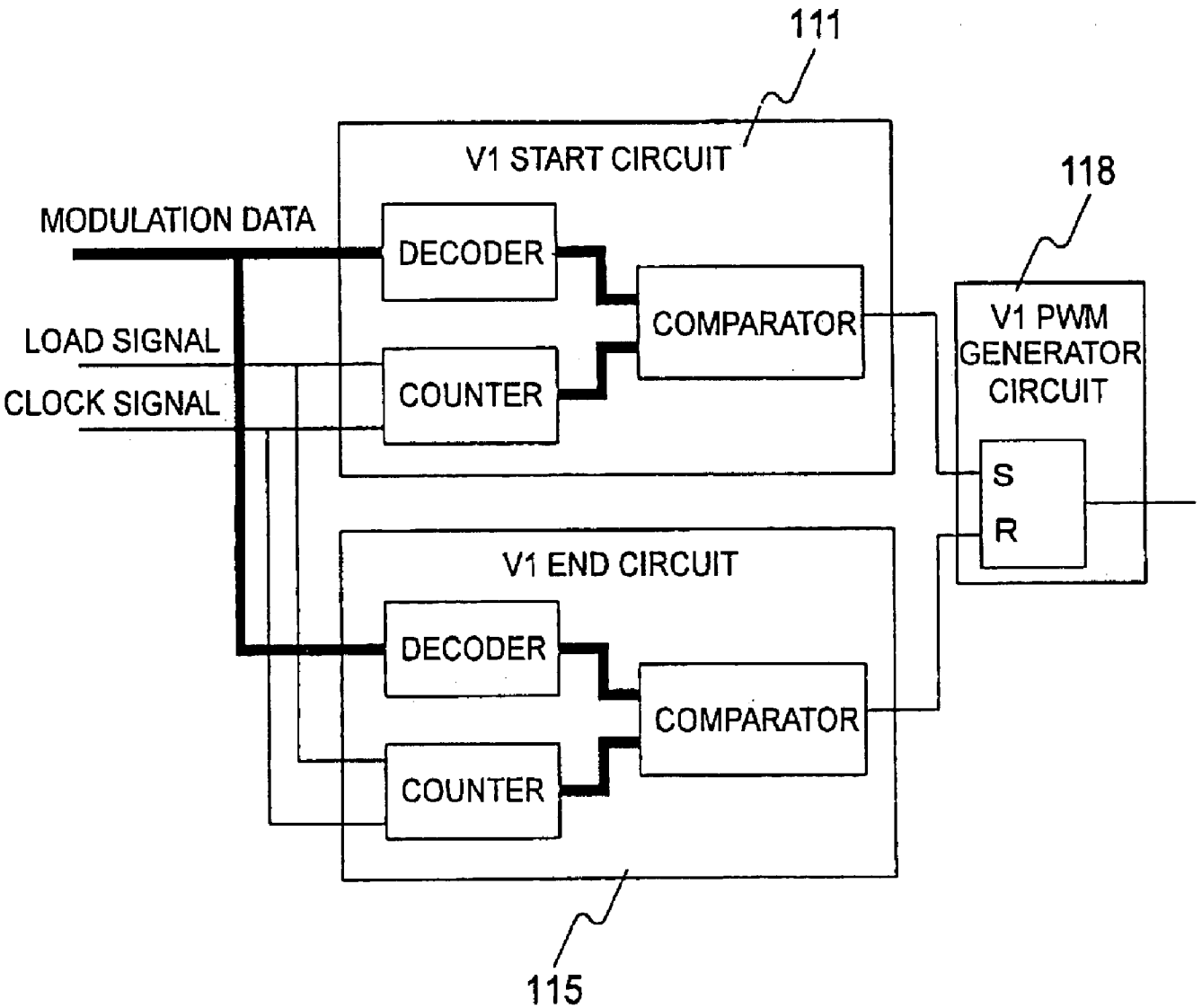
FIG. 4 is a block diagram of circuitry including a start circuit, an end circuit and a PWM generator circuit in FIG. 3.

FIG. 4 is a diagram showing a circuit configuration. Although only a combination of the V1 start circuit 111 , V1 end circuit 115, and V1 PWM generator circuit 118 is shown herein, the other start circuits, end circuits and PWM generator circuits are the same in configuration as the circuits of FIG. 4.

The V1 start circuit 111 is configured from a decoder, a counter, and a comparator. The V1 end circuit 115 is made up of a decoder, a counter and a comparator. The V1 PWM generator circuit 118 is formed of an RS flip-flop.

The decoder within the V1 start circuit 111 decodes a control signal contained in the modulation data and outputs decimal data. When an output value of the decoder in V1 start circuit 111 and an output of the counter in V1 start circuit 111 are equal to each other, a V1 start signal is output from the comparator in V1 start circuit 111.

In addition, the decoder within the V1 end circuit 115 decodes the control signal included in the modulation data and outputs decimal data. When an output value of the decoder in V1 end circuit 115 and an output of the counter in V1 end circuit 115 coincide, a V1 end signal is output from the comparator in V1 end circuit 115.

The above-noted start signal and end signal are input to the V1 PWM generator circuit 118 whereby a PWM output waveform TV1 is output, which corresponds to the V1 output. In FIG. 4 the V1 PWM generator circuit 118 is formed of the RS flip-flop. This RS flip-flop has a set terminal S and a reset terminal R. Letting the start signal be input to the flip-flop set terminal S and the end signal be input to the flip-flop reset terminal R results in a signal being output from the RS flip-flop as the PWM output waveform TV1 of the V1 PWM generator circuit 118, which signal rises up at an input timing of the start signal and falls down at an input timing of the end signal. It must be noted that although the RS flip-flop is used as the V1 PWM generator circuit 118 in the illustrative circuitry, a JK flip-flop or other similar suitable circuits are alternatively employable.

Figure 5:
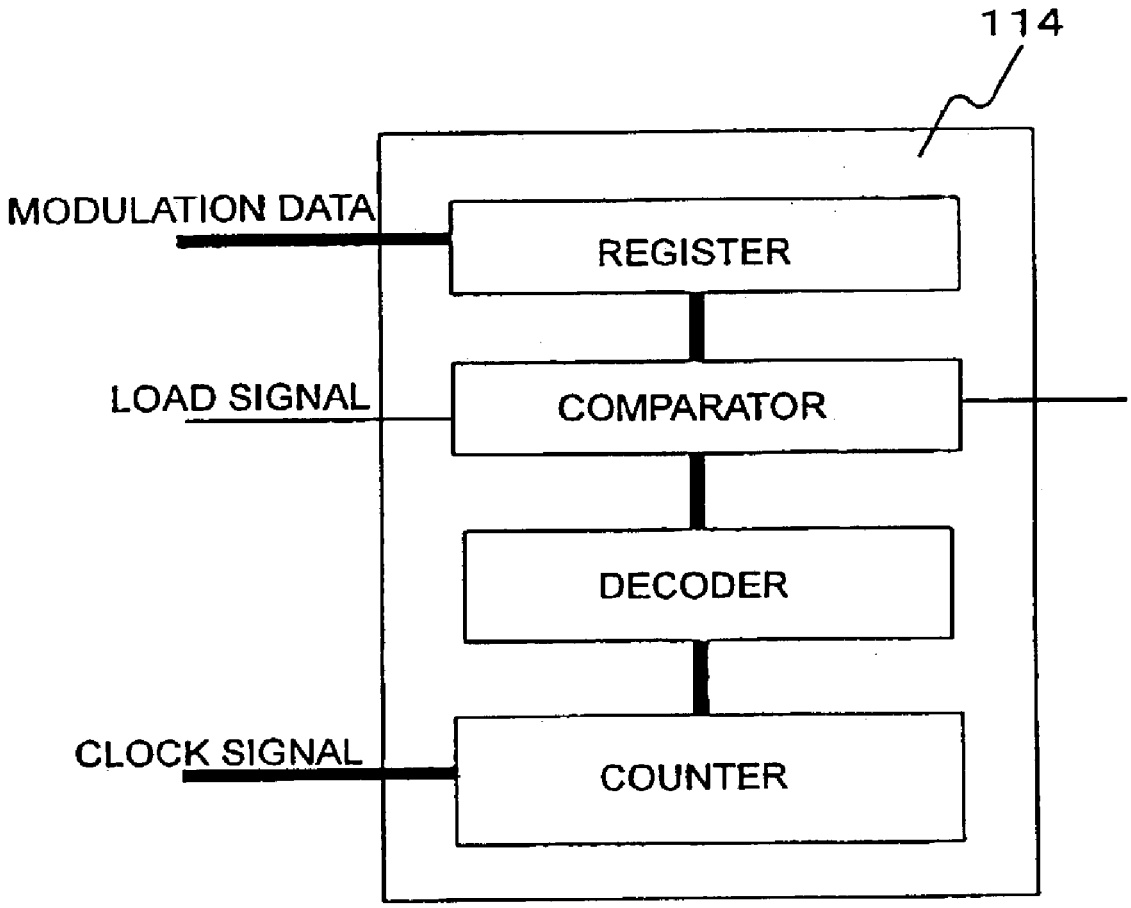
FIG. 5 is a block diagram of a dispersed pulse generator circuit in FIG. 3.

An explanation will next be given of the dispersed pulse generator circuit 114 while presenting an exemplary configuration thereof in FIG. 5

The dispersed pulse generator circuit 114 is made up of a counter, decoder, comparator, and register.

In the latch circuit 110, this receives each modulation data as output from each shift register 107 and then latches the data in response to a load signal that is output from the timing generator circuit 104. Here, the load signal as output from the timing generator circuit 104 is used also for a timing signal which triggers waveform startup of the dispersed pulse generator circuit 114.

The modulation data being latched at the latch circuit 110 is input to the register of the dispersed pulse generator circuit 114. A count start timing and a count clock are input to the counter. The comparator compares decode data of the counter to data of the register and generates an output signal in case these are equal to each other. A pulse dispersion pattern is to be determined based on dispersion rules which are set in this dispersed pulse generator circuit 114.

Figure 6:
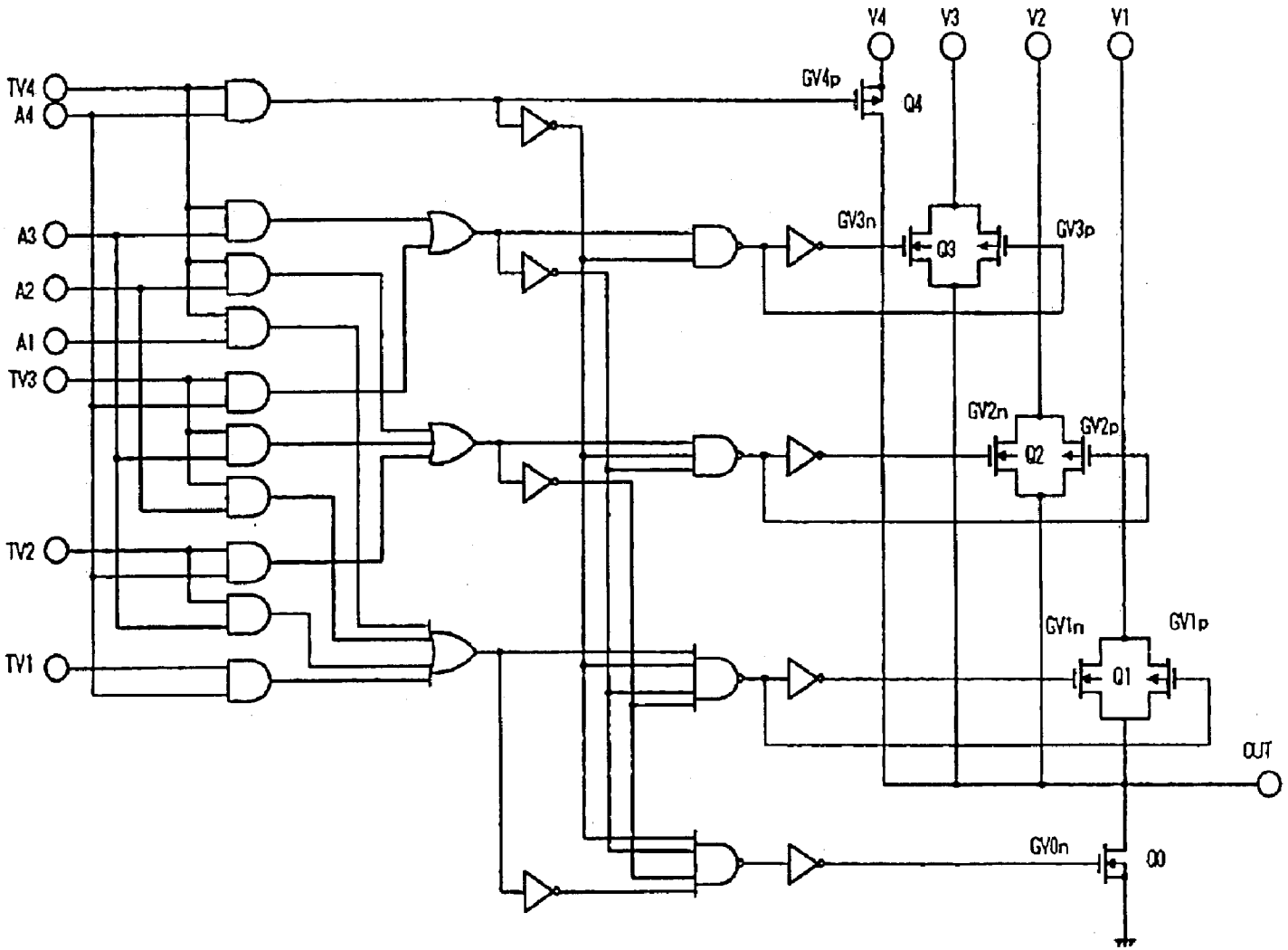
FIG. 6 is a block diagram of an output stage circuit in FIG. 3.

FIG. 6 shows one example of circuitry for use as the output stage circuit 109 shown in FIG. 3, which circuitry is provided per column wiring. In the circuitry of FIG. 6, voltage potentials V1 to V4 are designed to satisfy the following relation: 0<V1<V2<V3<V4. These potentials V1–V4 are output in a way corresponding to the PWM output waveforms TV1–TV4 , respectively. Paired transistors Q1–Q3 and a transistor Q4 are provided for outputting the potentials V1–V4 to an output terminal OUT, respectively.

The PWM output waveforms TV1–TV4 are applied through logic circuits to gates GV0*n* to GV3*n* and GV4*p* of the transistors Q1–Q4 respectively to ensure that more than one transistor of the transistors Q1–Q4 do not turn on simultaneously even when more than one of the PWM output waveforms are at H level while permitting output of only a maximal one of those potentials corresponding to the PWM output waveforms staying at H level. Whereby, a unit pulse with its wave height or peak value An is output to the output terminal OUT as a waveform of V1–V4 levels in accordance with luminance data.

Figure 7:
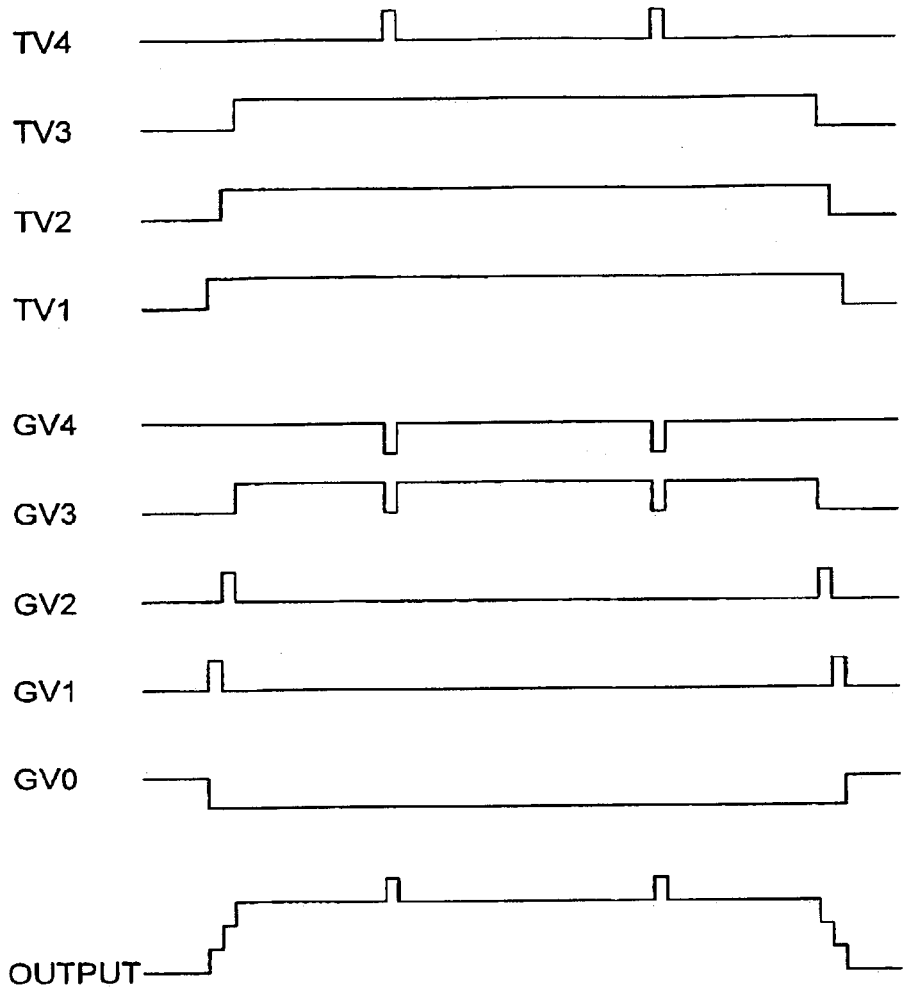
FIG. 7 is a timing diagram showing an exemplary PWM output waveform along with examples of modulation signal drive waveforms.

An example of the relationship of the PWM output waveforms TV1–TV4 , GV0*n*–GV4*p*, and modulation signal waveforms as output from the output stage circuit 109 is shown in FIG. 7.

Figure 8:
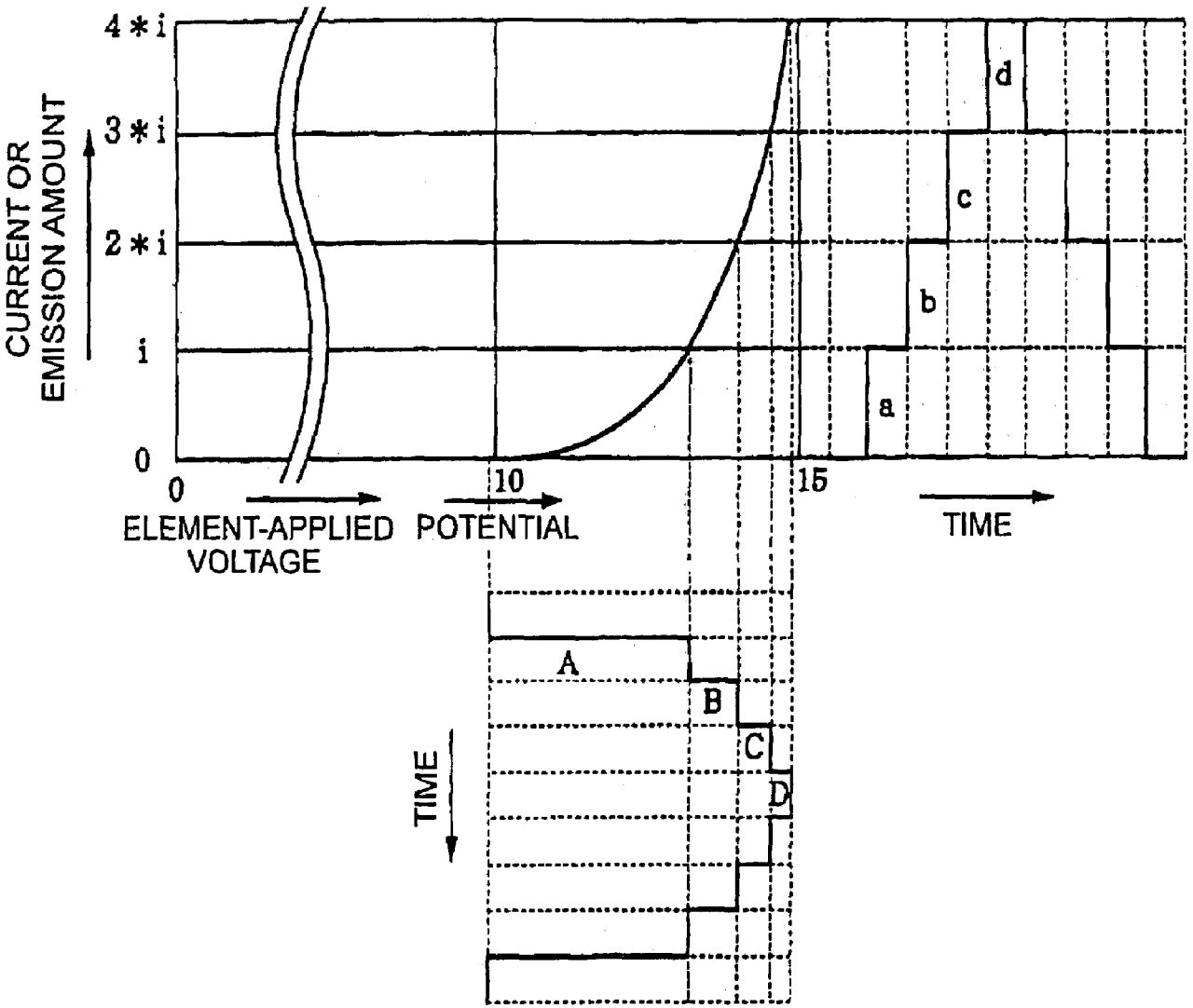
FIG. 8 is a graph showing emission element voltage versus luminescence intensity characteristics (current equidivision)
Figure 9:
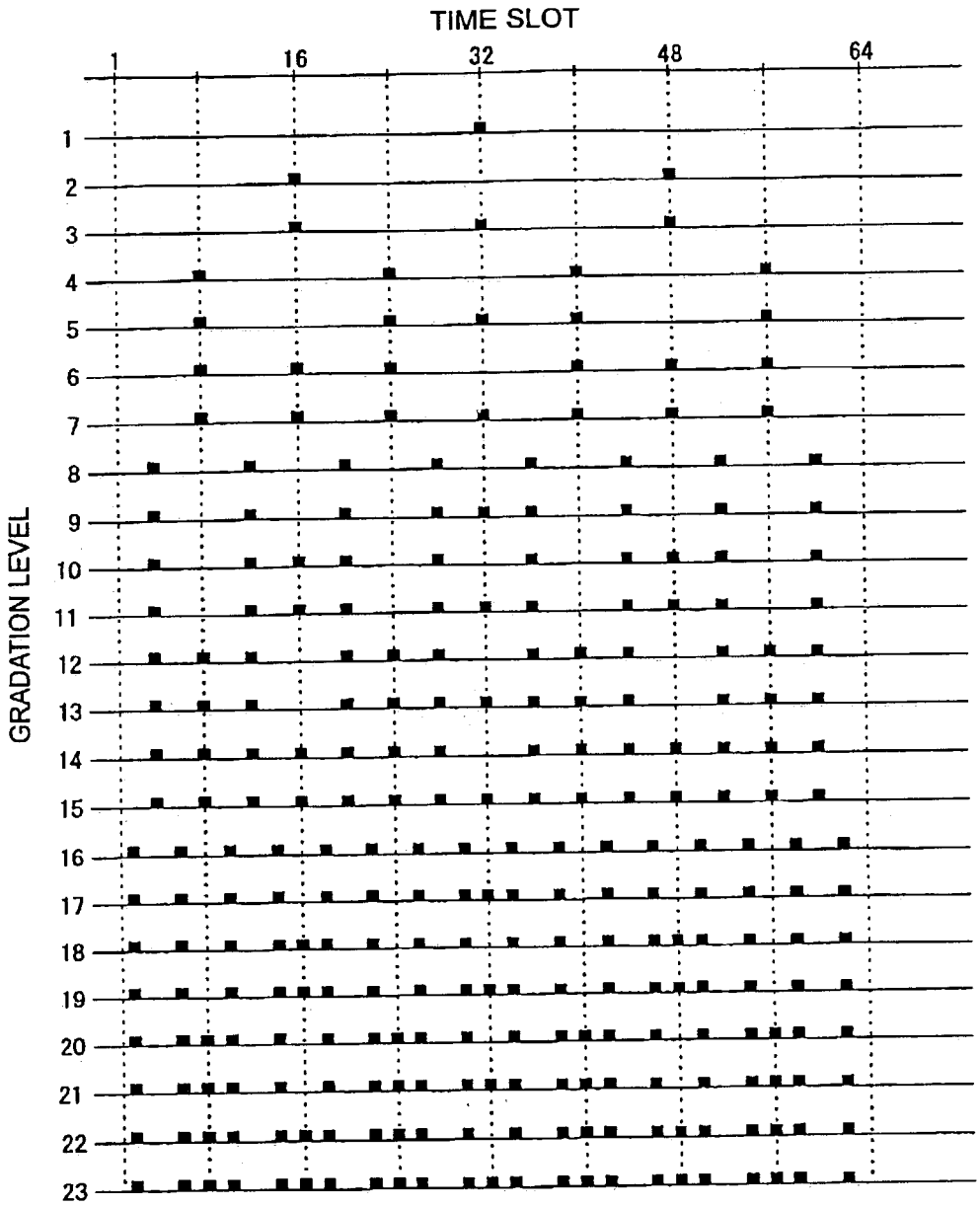
FIGS. 9 through 20 are diagrams each showing exemplary waveforms of a modulation signal.
Figure 10:
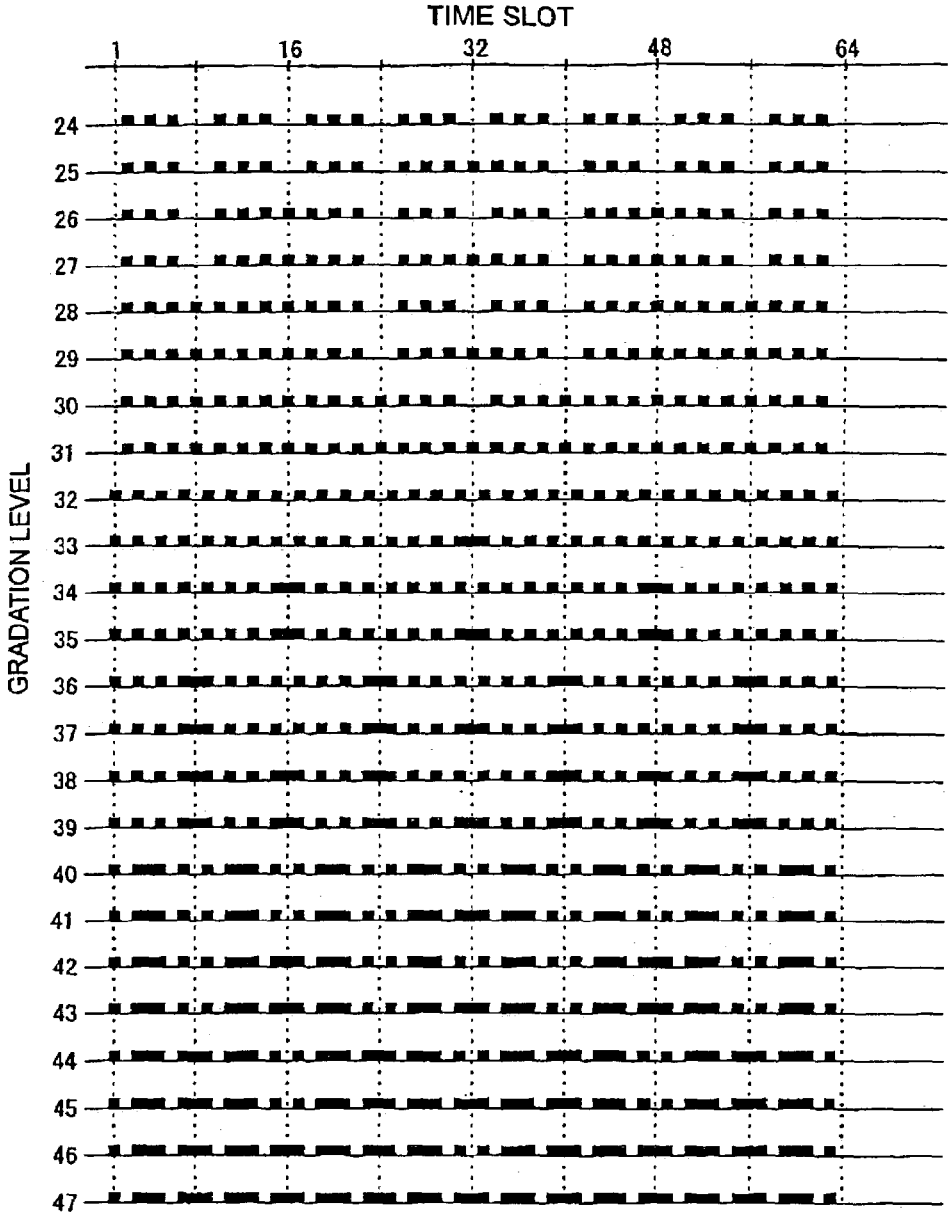
Figure 11:
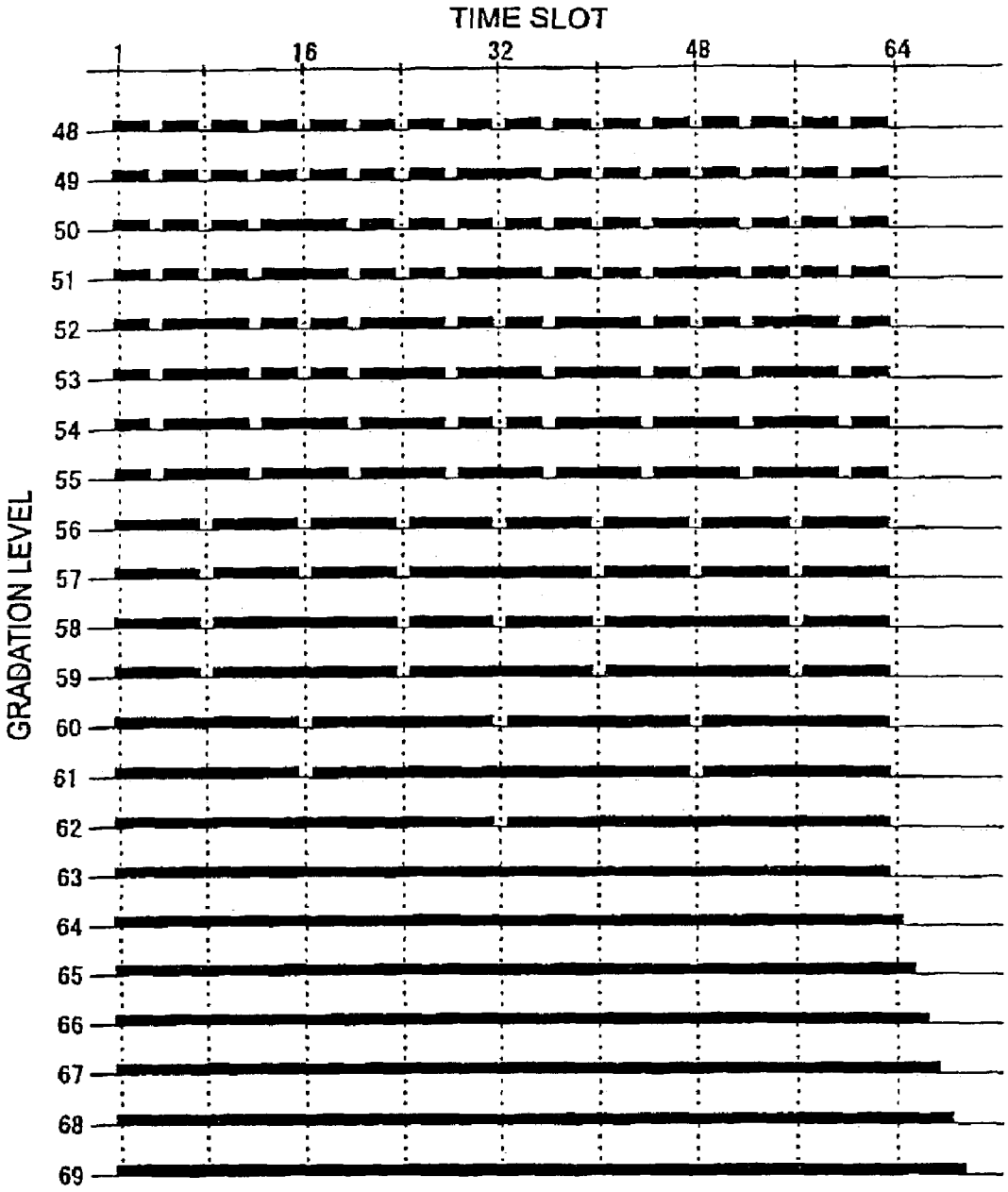
Figure 12:
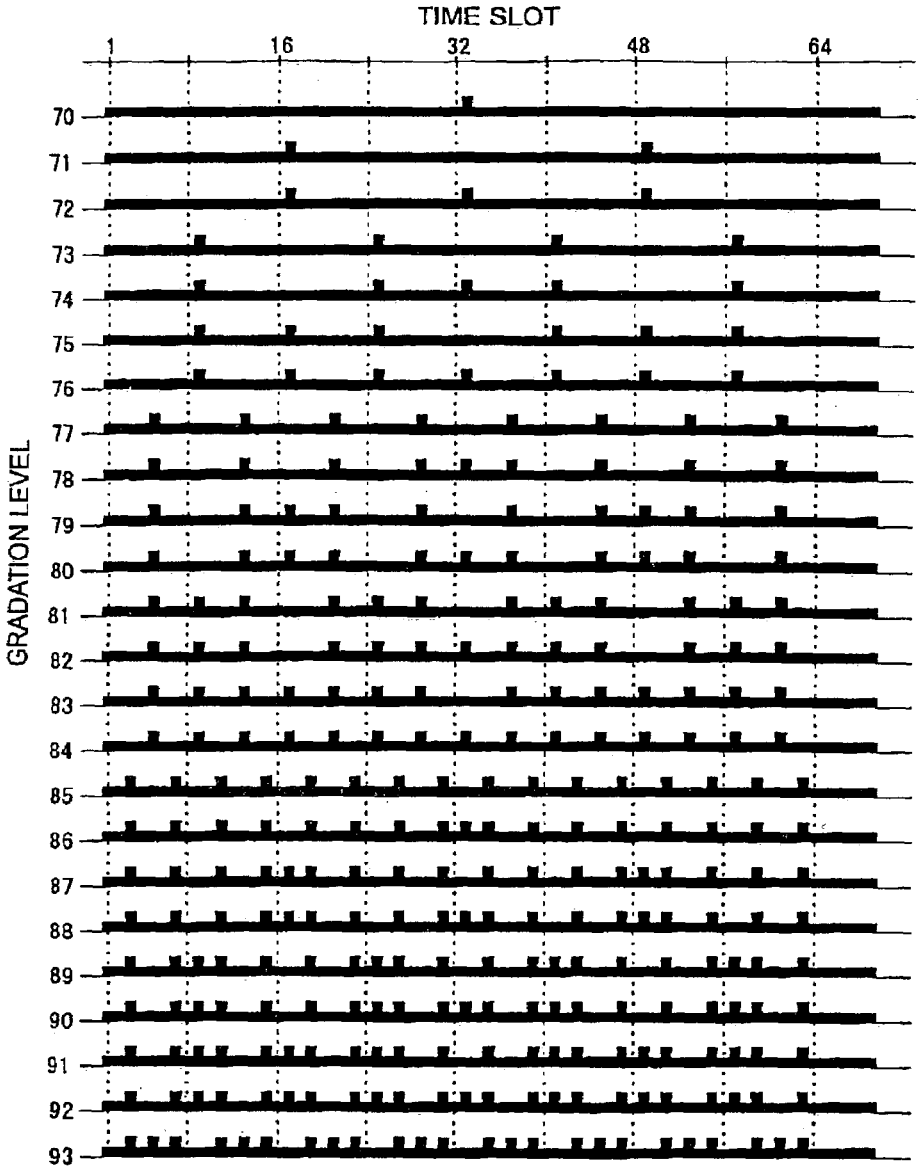
Figure 13:
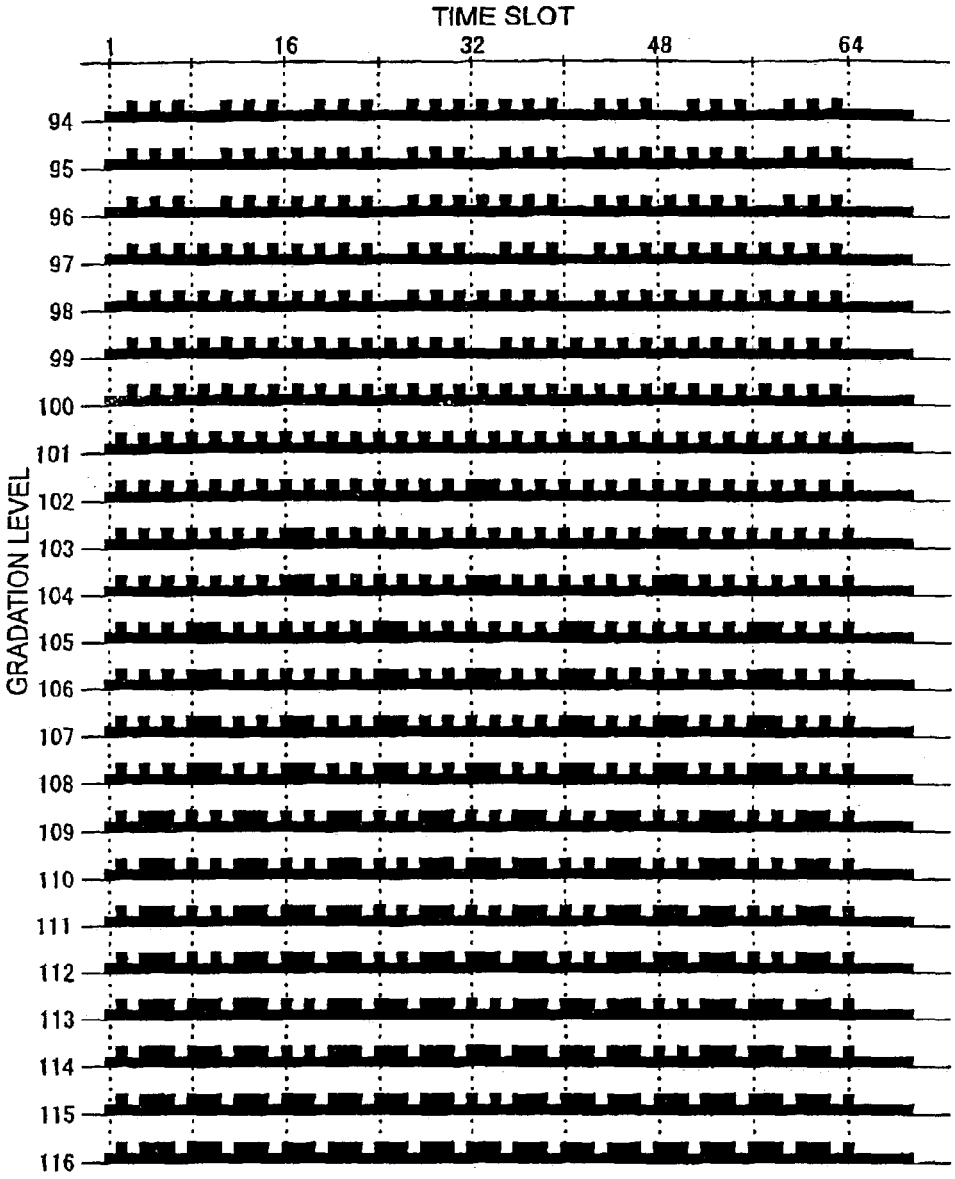
Figure 14:
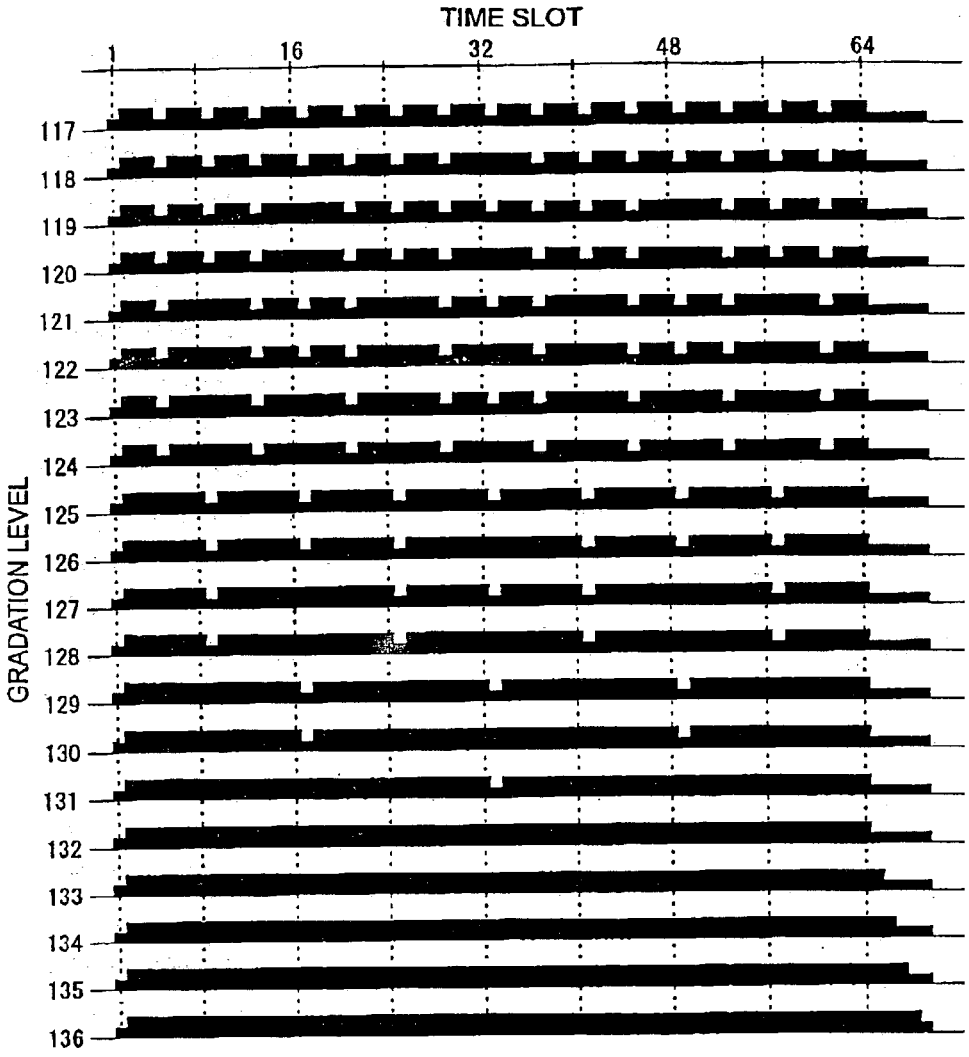
Figure 15:
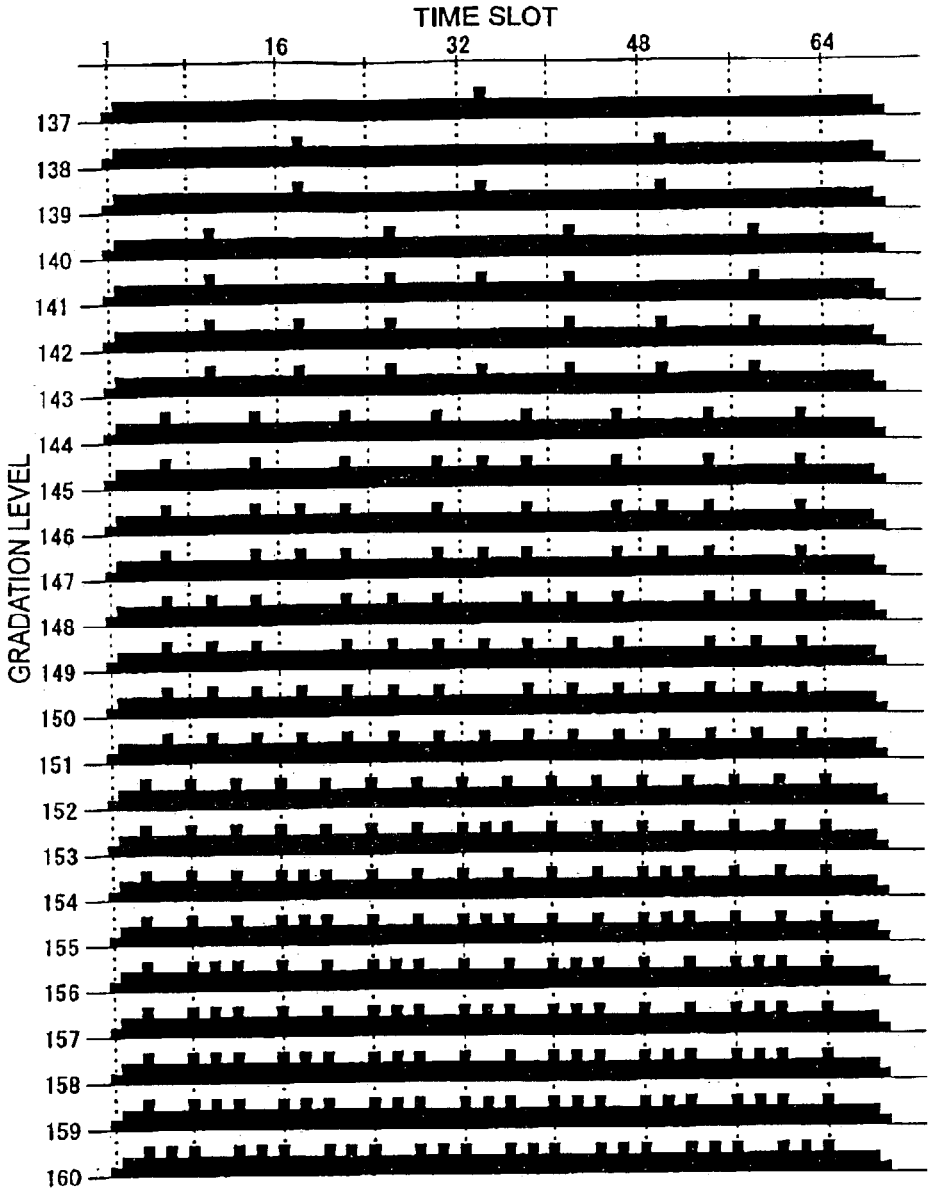
Figure 16:
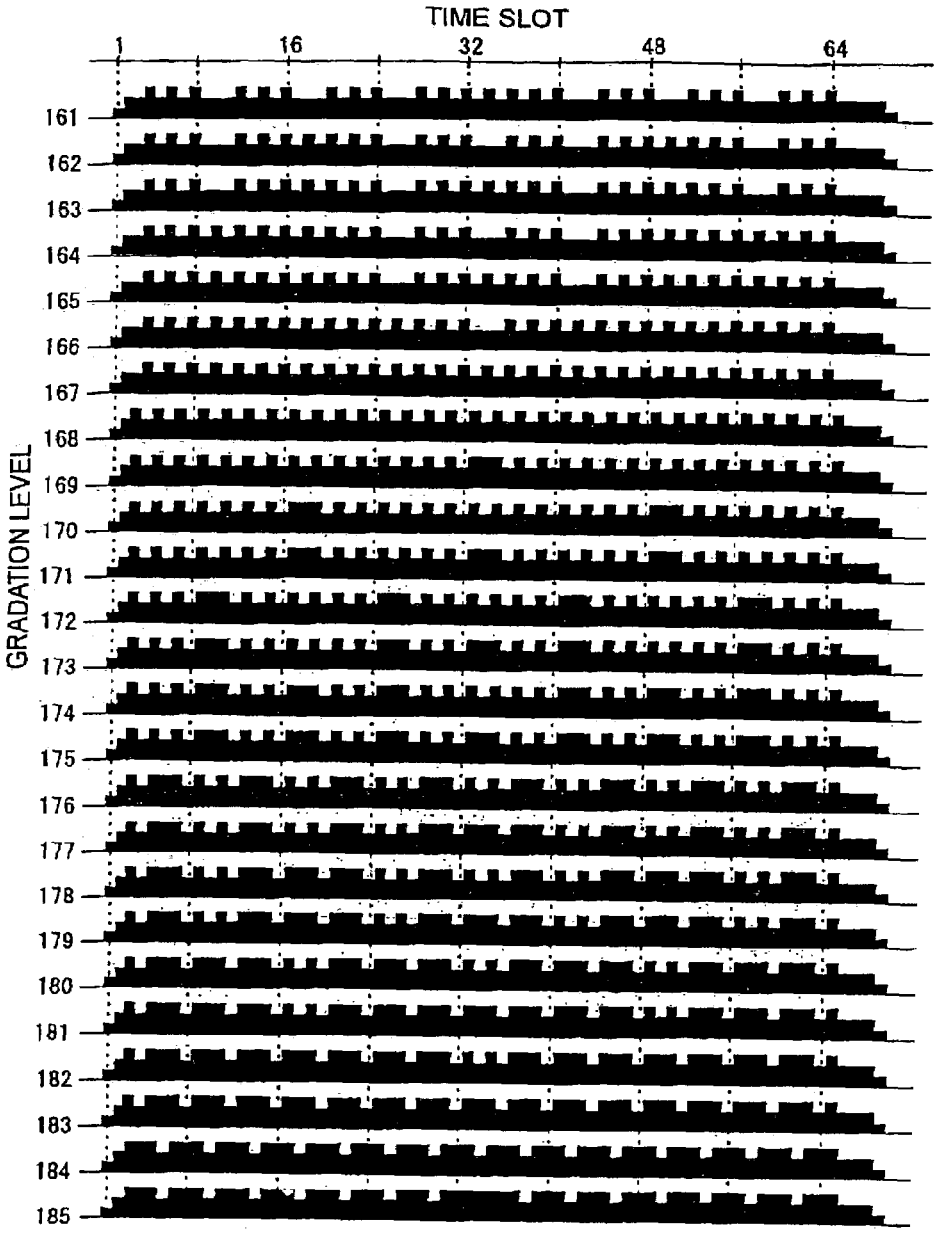
Figure 17:
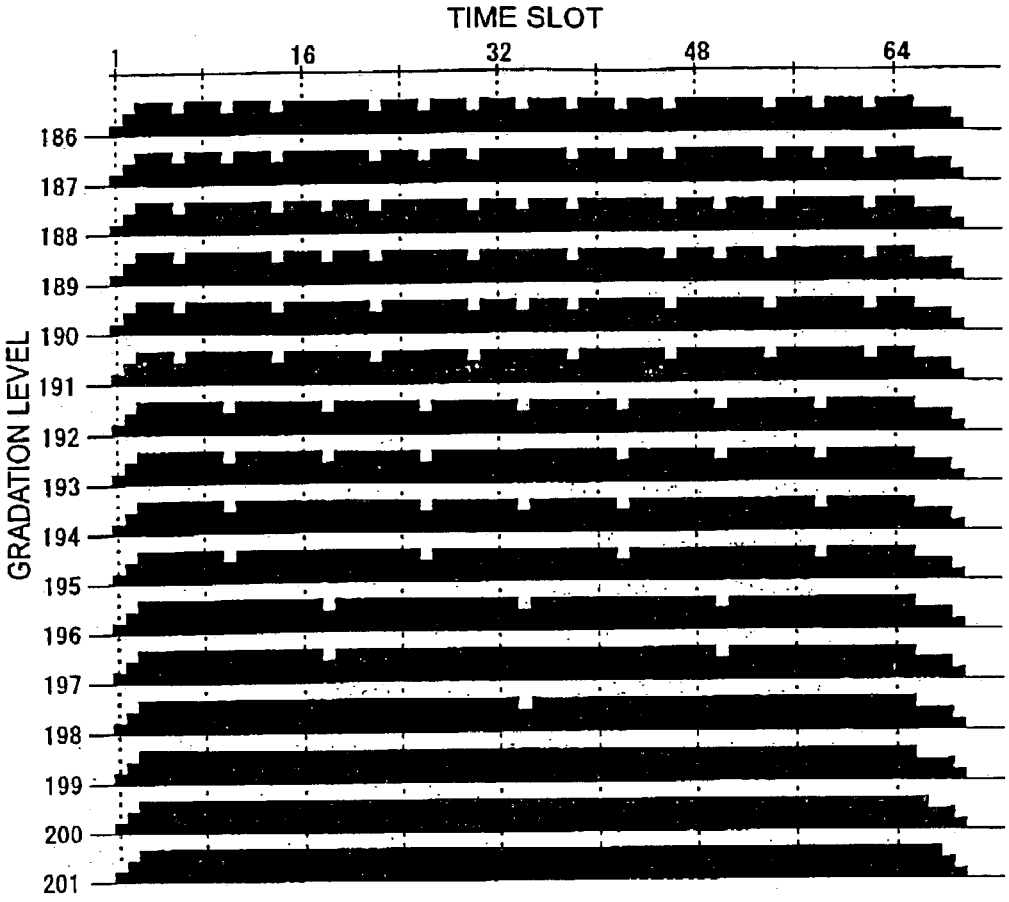
Figure 18:
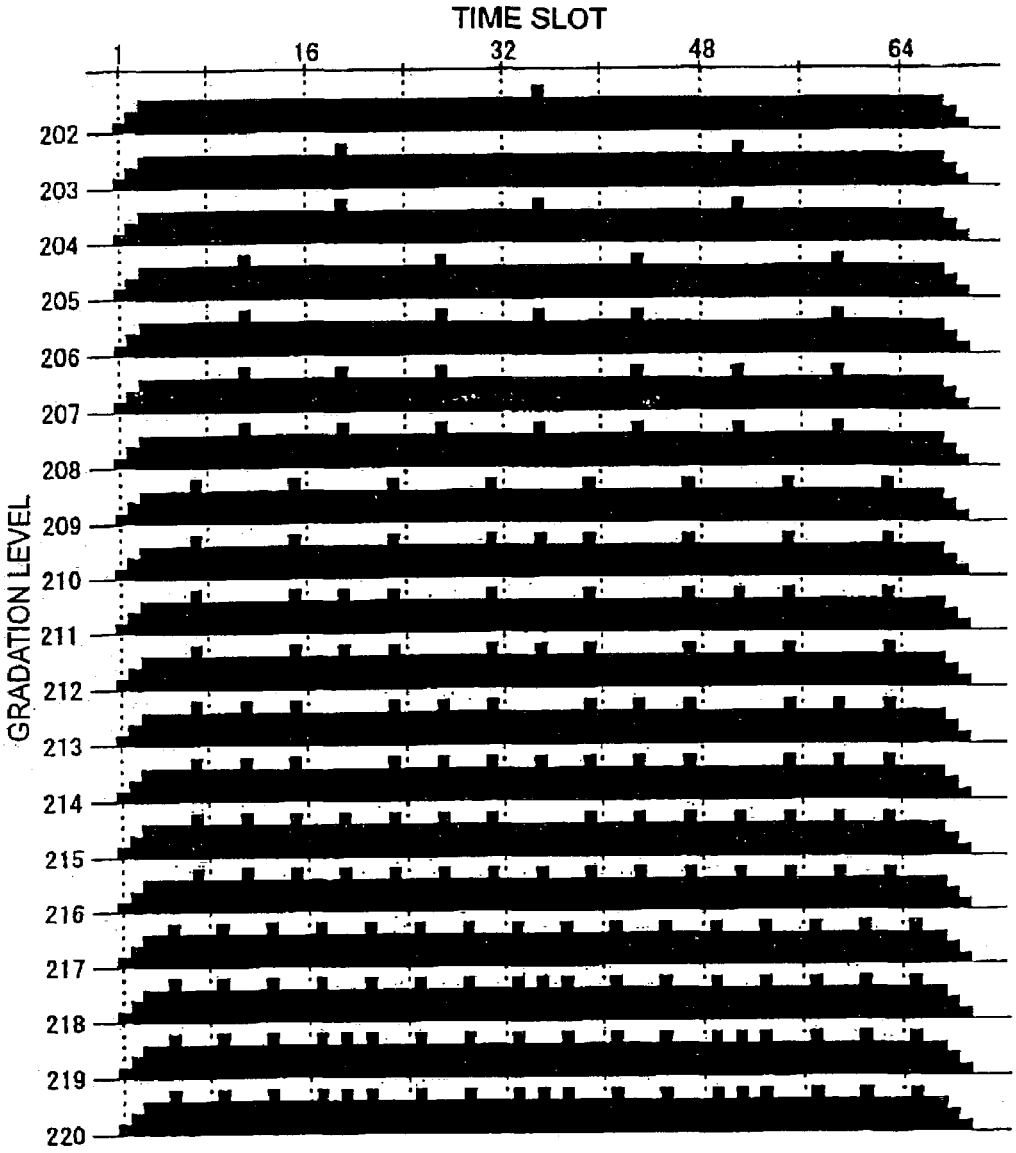
Figure 19:
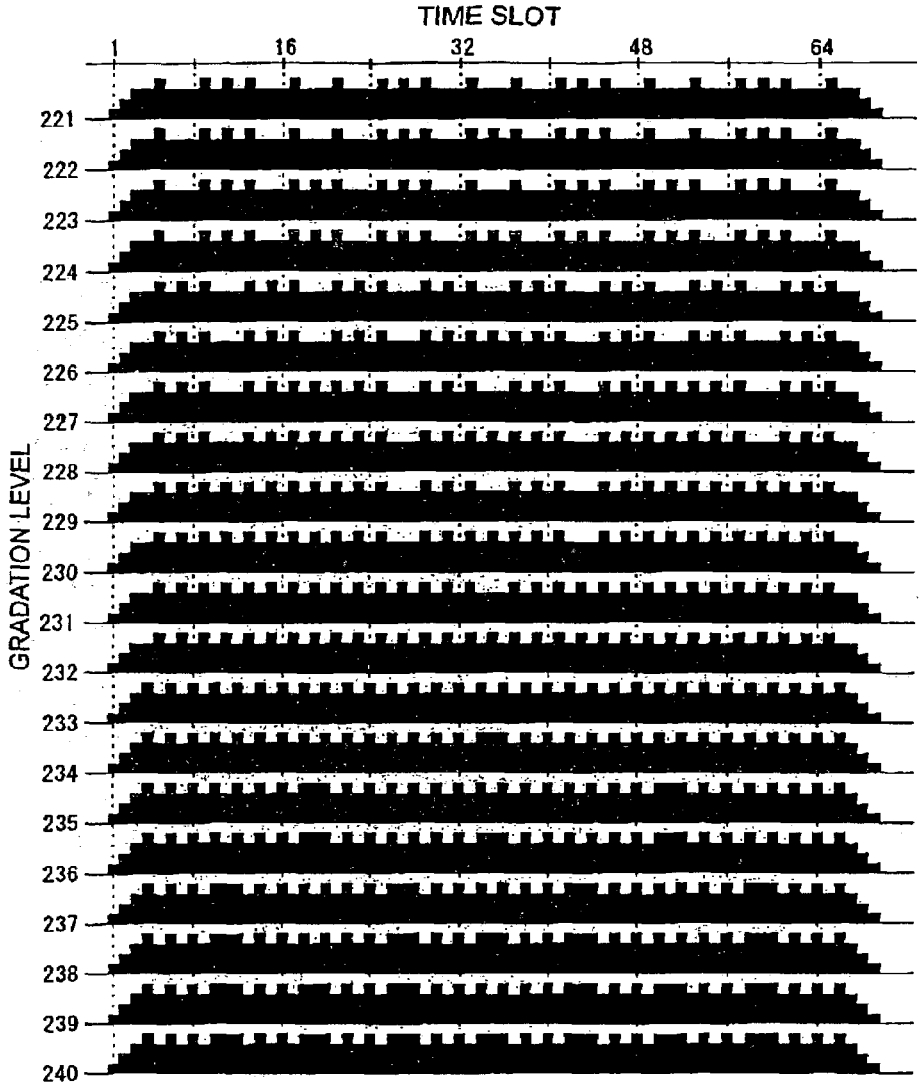
Figure 20:
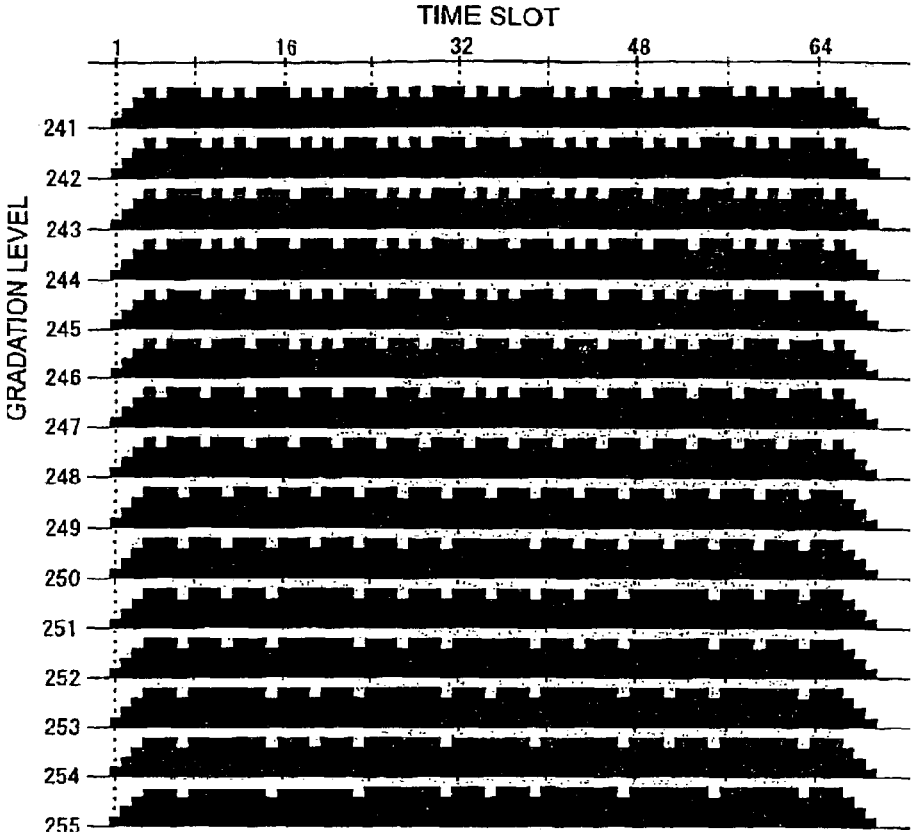

FIG. 8 graphically shows the voltage versus luminescence intensity characteristics of a light emitting element with its voltage to luminescence intensity characteristics exhibiting nonlinear threshold value properties, such as a LED or an electron emitting element. The lateral axis of this graph represents a voltage applied, while its vertical axis indicates the luminescence intensity.

By specifically setting respective drive level potentials V1, V2, V3 and V4 in such a way that the resultant luminescence intensity ratio is 1:2:3:4, the light emission amount of each region a, b, c, d in the graph showing a change in light emission amount overtime is made equal. In other words, optimally setting each drive level potential of V1, V2, V3, V4 makes it possible to equalize the light emission amounts in unit drive waveform blocks A, B, C and D shown in the over-time drive waveform change graph. Each of the unit drive waveform block of A, B, C, D consists of a unit pulse width Δt and a unit peak value, that is, a voltage (potential difference) V4–V3, V3–V2, V2–V1, V1–V0. Here, the potentials V1 to V4 are defined so that the emission amount of each of the unit drive waveform blocks A to D is almost identical to 1LSB (one gradation) of the luminance data.

Note that a selection potential is given as a base potential to an element via a scan signal transmission wiring. Here, the selection potential Vs is set at −9.9 volts [V]. Hence, assuming that any possible influence of voltage drop is ignored, the element-applied voltages are respectively given as V1−(−9.9). V2−(−9.9), V3−(−9.9), V4−(−9.9) [V] when the drive signal levels are at V1, V2, V3, V4. Additionally, V0 is selected so that V0−(−9.9) [V] is less than or equal to the drive voltage threshold level of the element. Here, let V0 be set at ground potential. This value is the same as the element's drive voltage threshold value. The element drive voltage threshold value is 9.9 [V].

FIGS. 9 through 20 show one exemplary pattern of modulation signal waveforms—that is, the shape of a drive waveform being applied to a column wiring in order to represent gradation. In each of these diagrams, the abscissa axis indicates a time slot, whereas the ordinate shows gradation. Note that the time slot is a unit which is the effective light emission time (net drive time) of a row wiring divided by a specified time width, wherein the effective light emission time is calculated from one horizontal scanning time period. Let a pulse having the width of a single time slot (slot width Δt) be defined as a unit pulse (unit drive waveform block).

Each gradation signal consists of an appropriate number of unit drive waveform blocks, which number is equivalent to the number of gradation levels. One gradation consists of a single unit drive waveform block; two gradations consist of two unit drive waveform blocks; and, N gradations are of N unit drive waveform blocks.

In the illustrative embodiment, in order to visually display image data with a data bit length R of 8 bits, P=7 bits may be used to perform pulse width control of unit pulses with the slot width At within a range of from 0 to 69 ones, while using Q=2 bits containing the remaining 1 bit to perform peak value (amplitude) control within a range of peak levels 1 to 4, i.e. the peak values V1 to V4. In other words, in order to display 8-bit image data, the data bit lengths R, P, Q are set in the relation of R<P+Q.

In the case of R=P+Q, when using upper 2 bits for peak value control while using the remaining 6 bits for pulse width control, by way of example, it is no longer possible to represent all of the 8-bit image data in the event that the rising portion and/or falling portion of a drive waveform is in the form of a stair-step-like shape. In brief, the gradation number decreases. However, in this embodiment, 7 bits are used to perform the pulse width control in such a way as to establish the relation R<P+Q. Thus it is possible to successfully represent all of the 8-bit image data.

As shown in FIGS. 9 to 20, the modulation signal generated by the driving device in accordance with the embodiment is designed to have a waveform in the form of the stair step-like shape with one unit pulse or a combination of a plurality of unit pulses. And, in case the modulation signal includes more than one unit pulses (gradation levels 2 to 62), modulation control is done in such a way as to provide a waveform which permits them to appear in a dispersed pattern within a specified effective light emission time period.

In addition, modulation control is done in such a way that the modulation signal has its waveform with a combination of n kinds of multiple unit pulses having peak values A1 to An (n is an integer greater than or equal to 2; A1<A2<. . . <An) of the peak values V1–V4 as shown at gradation levels 71 to 131, 138–198 and 203–255, while at the same time forcing it to have a waveform in which they appear in a temporally dispersed pattern within the specified effective light emission time period when including more than one unit pulses with the maximum peak value.

More specifically, the modulator circuit 102 of this embodiment is capable of outputting four kinds of unit pulses with the identical width and with the peak values A1 to A4 and controls the peak value and the width of a modulation signal through changing the kind and the number of output unit pulses in accordance with the luminance data. And, the modulator circuit 102 makes unit pulses having a maximal peak value appear dispersedly within the effective light emission time period in case of outputting more than one unit pulse with the maximal peak value out of unit pulses which comprise the modulation signal.

Arranging the modulation signal by the dispersed pulses in the way stated above results in the voltage to be applied to each column wiring being dispersed within the effective emission time period. This in turn makes it possible to avoid unwanted flow of large currents into row wirings at once. Thus it is possible to average the currents flowing in the row wirings over an entirety of the effective emission time period, thereby enabling suppression of a decrease in display quality otherwise occurring due to voltage drop.

Figure 21:
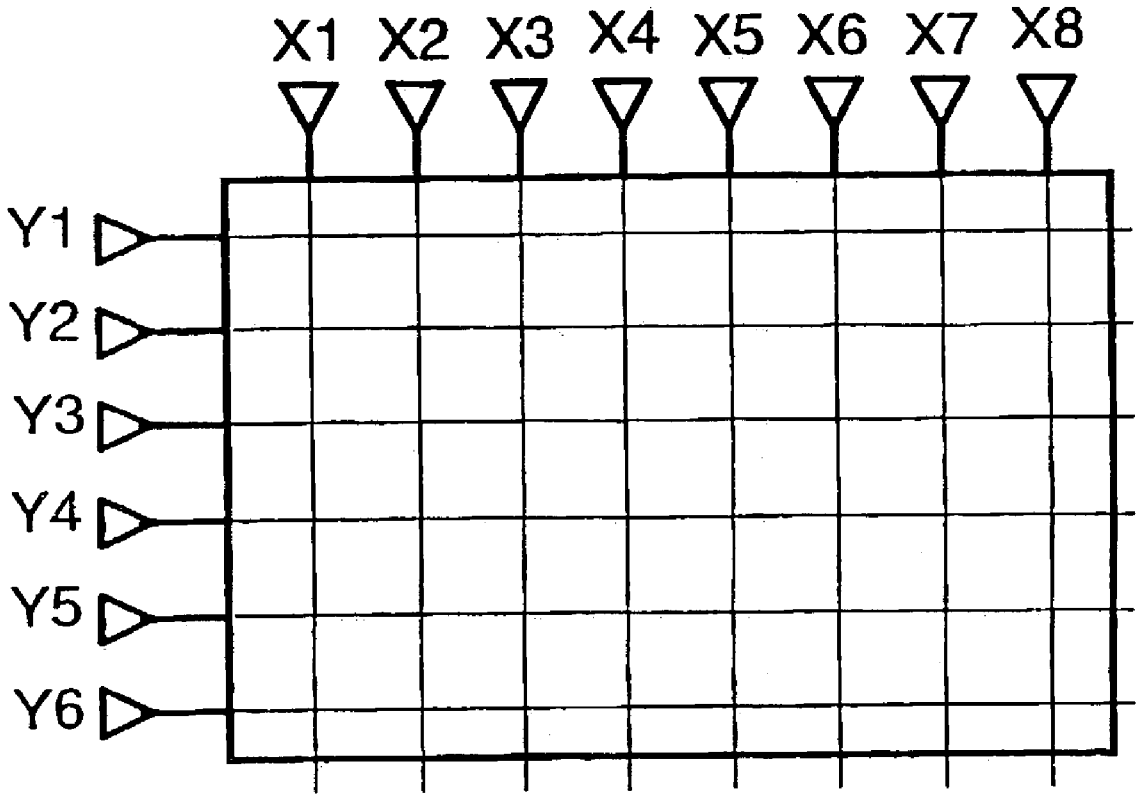
FIG. 21 is a diagram showing a configuration of an image display apparatus with a 8-by-6 matrix.
Figure 22:
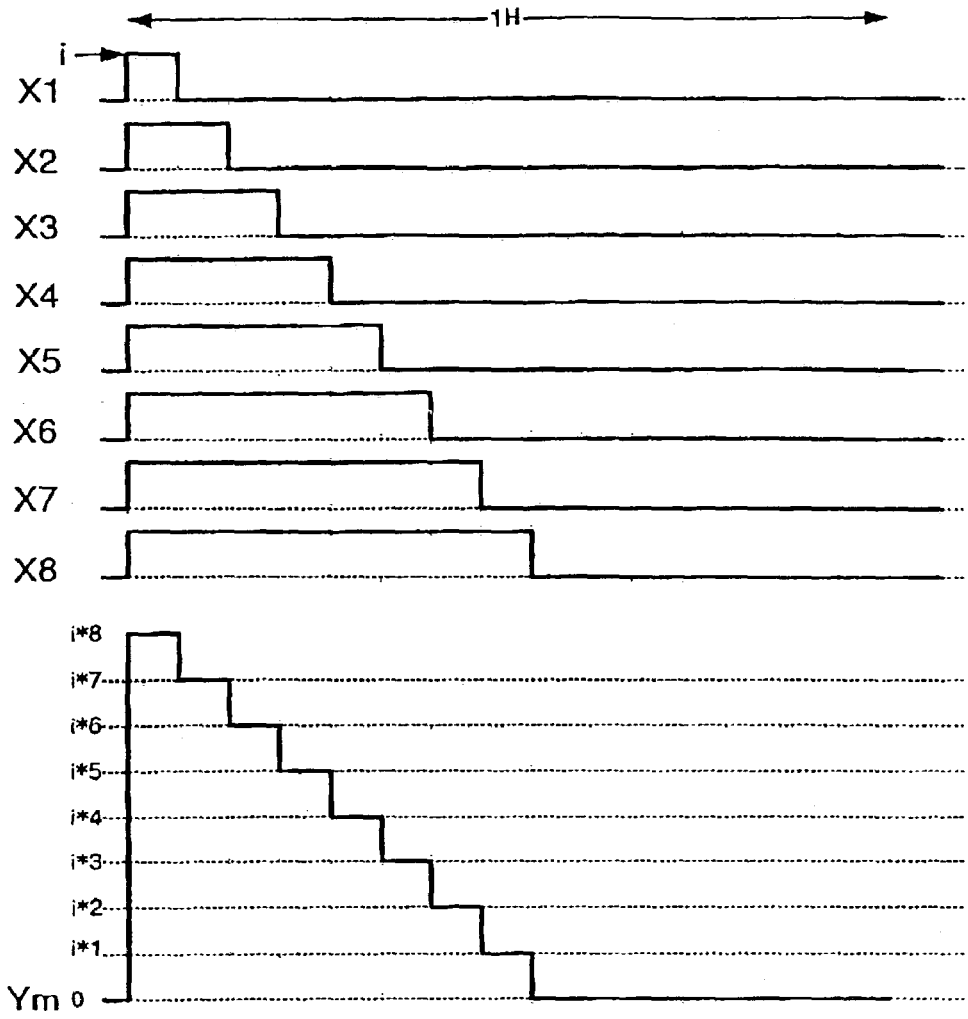
FIG. 22 is a waveform diagram showing drive waveforms in a conventional PWM circuit in case that luminance data is of 1 to 8 along with the waveform of a current flowing in a row wiring.
Figure 23:
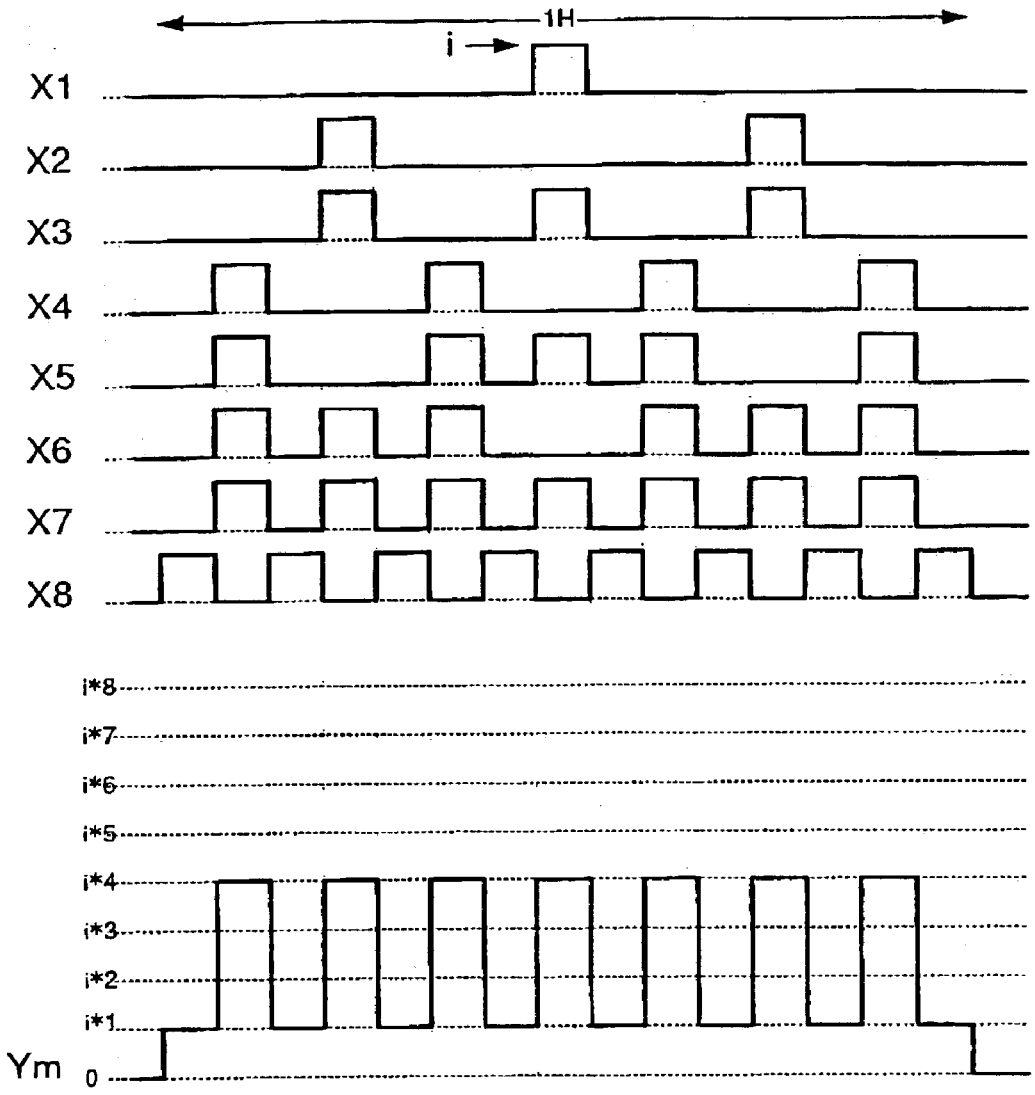
FIG. 23 is a waveform diagram showing drive waveforms in a PWM circuit of the first embodiment in case that the luminance data is 1 to 8 along with the waveform of a current flowing in a row wiring.

A further explanation will be added of the above-noted operation and effect by use of FIGS. 21 to 23. FIG. 21 is a pictorial representation of an image display apparatus with a 8-by-6 matrix. FIG. 22 shows drive waveforms in a modulator circuit in the related art, along with a current flowing in a row wiring; FIG. 23 shows drive waveforms in the modulator circuit in accordance with this embodiment along with a row wiring current. Here, the maximum luminance is assumed to be 16 for purposes of simplification in explanation.

Suppose that a modulation signal corresponding to the gradation levels 1 to 8 is applied to a respective one of column wirings X1 to X8. In this case, the related art modulator circuit is such that a single pulse signal is applied, with pulses simply identical in rising edges to one another as shown in FIG. 22. This results in flow of a current represented by i×8 in maximum into a selected row wiring Ym, where i is the flow of a current per light emitting element. Obviously, due to this current flow, voltage drop can occur, which in turn causes the voltage being applied to a light emitting element to decrease in potential.

On the contrary, the modulator circuit in accordance with this embodiment is such that the pulses are dispersed within an effective light emission time period (1H) as shown in FIG. 23 whereby the currents that rush to flow into the row wiring Ym at a time decrease in magnitude. A maximal current in this case is given as i×4, which is lessened to half (½) of that in the related art modulator circuit. Accordingly the element-applied voltage also decreases to ½ in voltage drop amount. Thus it becomes possible to lighten the display quality reducibility.

Another important feature of the embodiment is that as shown in FIGS. 9–20, the drive waveforms withal level (potential V1) to k level (potential Vk) are designed so that all the levels are sequentially output in an order of sequence of from a lower level to a higher level at the time of drive waveform rise-up when the maximum peak value level of the X-th gradation is k (k is an integer greater than or equal to 2 and yet less than or equal to n) while retaining each level output for a specified length of time that is greater than or equal to the unit pulse width Δt. More specifically, at the time of riseup, a unit pulse with either the peak value Ak or the peak value Ak−1 must infallibly come in front of a unit pulse with the peak value Ak.

Whereby, it is possible to suppress generation of overshoot and ringing upon rising up of drive waveforms, which in turn makes it possible to preclude unwanted application of abnormal loads to the elements involved.

Further at this time, it is preferable to combine the unit pulses with respective peak values in such a way that the drive waveform of interest rises up with a time substantially equal to or longer than zero to ninety percent (0 to 90%) of the time constant. The term "0 to 90% of the time constant" as used herein is the one that is measurable at a portion which supplies the drive waveform to a column wiring and refers to a time as taken for a potential at this portion from beginning to change to reaching an aimed potential level which is 0.9 times of a potential difference between a desired potential and itself when letting the drive waveform rise up to the desired potential. This time constant is determinable by the load of a column wiring and the driving ability of the modulator circuit per se. Using the technique for forcing the drive waveform to rise up with the time almost equal to or longer than 0 to 90% of the time constant makes it possible to apply a voltage that is more than 90% of the voltage to be applied across the both ends of an electron source. This in turn enables achievement of the intended luminance with more than 90% of a desired light emission amount.

Similarly when the drive waveform falls down also, the drive waveforms with the k level (potential Vk) to 1 level (potential V1) are arranged so that all the levels are sequentially output in the order of from a higher level to a lower level while holding each level output for a specified length of duration that is greater than or equal to the unit pulse width Δt. More specifically at the time of fall-down, the unit pulse with either the peak value Ak or the peak value Ak−1 must come, without fail, immediately after the unit pulse with the peak value Ak.

With such an arrangement, it is possible to suppress creation of under-shoot and ringing at the time of falling of the drive waveform. This makes it possible to prevent unwanted application of abnormal loads to the elements.

Additionally the embodiment is arranged to generate the intended modulation signal by use of both the pulse width control and the pulse peak value control in combination; thus, it is possible to set the resolution of peak values in the pulse peak value control—namely, the minimum peak value difference—at easily realizable values. It is also possible to make the resolution of the pulse width control, i.e., the slot width, more significant to thereby lessen the maximum frequency and maximum peak value of drive signals. Thus it is possible to reduce some rounding of the drive waveform edges, which in turn enables prevention of degradation of tonality, especially at low gradation levels. In addition, both the peak value resolution and the pulse width resolution may be lowered to thereby simplify the configuration of the circuitry required, thus making it possible to reduce production costs.

As apparent from the foregoing description, according to the driving device of this embodiment, it is possible to accurately drive the electron sources in response to modulation data (luminance data) as input thereto. This in turn makes it possible to visually display picture images with high quality and enhanced fidelity.

(Second Embodiment)

A second embodiment of the invention will be described with reference to FIGS. 24 to 26 below. Although in the first embodiment stated above is arranged to employ the same dispersion rule to all the column wirings involved, the second embodiment is such that the dispersion rule to be applied to one column wiring is made different from the dispersion rule for its neighboring column wiring. The other arrangement and functional operability of this embodiment are the same as those of the first embodiment so that any detailed explanation thereof will be omitted herein.

Figure 24:
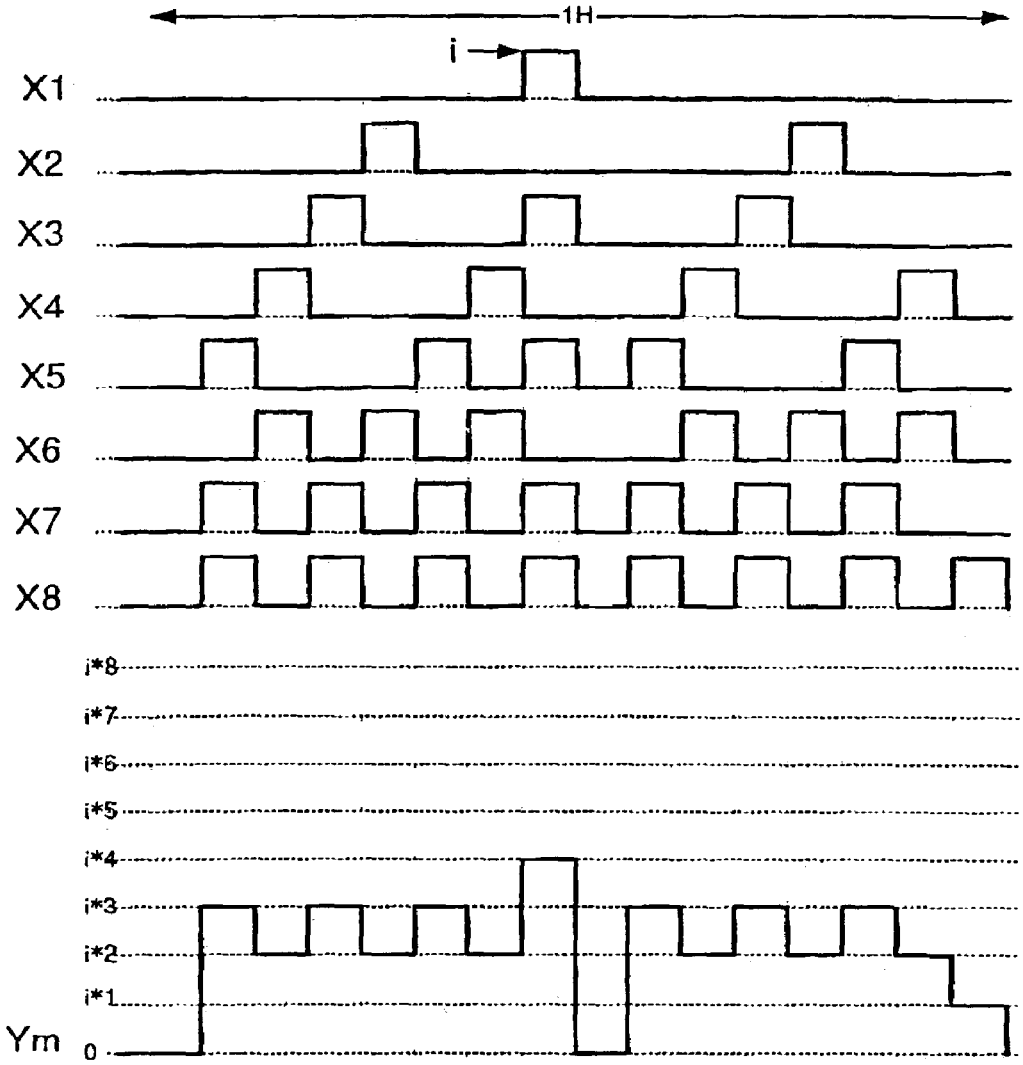
FIG. 24 is a waveform diagram showing drive waveforms in a PWM circuit of a second embodiment in case that the luminance data is 1 to 8 along with the waveform of a current flowing in a row wiring.

See FIG. 24, which shows drive waveforms in a pulse width modulation (PWM) circuit in accordance with this embodiment. In this example the maximum luminance is set at 16 for purposes of simplification in explanation.

In this embodiment a plurality of column wirings includes a first group of column wirings (odd-numbered columns) and a second group of column wirings (even-numbered columns). The drive waveform of a modulation signal being applied to the first group of odd-numbered column wirings is generated in deference to the same dispersion rule as that in the first embodiment stated supra. In contrast, the modulation signal's drive waveform being applied to the second group of even-numbered column wirings is generated in conformity with a specific dispersion rule for providing a waveform that is shifted or offset to delay by a degree equivalent to a single slot when compared to the waveform of the first embodiment. This is called the "one-slot offset" technique.

The degree of resultant pulse dispersion increases with the 1-slot offset scheme so that currents which flow in the row wiring Ym at a time decrease more. Thus it is possible to further lessen the drop amount of an element-applied voltage, thereby enabling further improvement in display quality.

Figure 25:
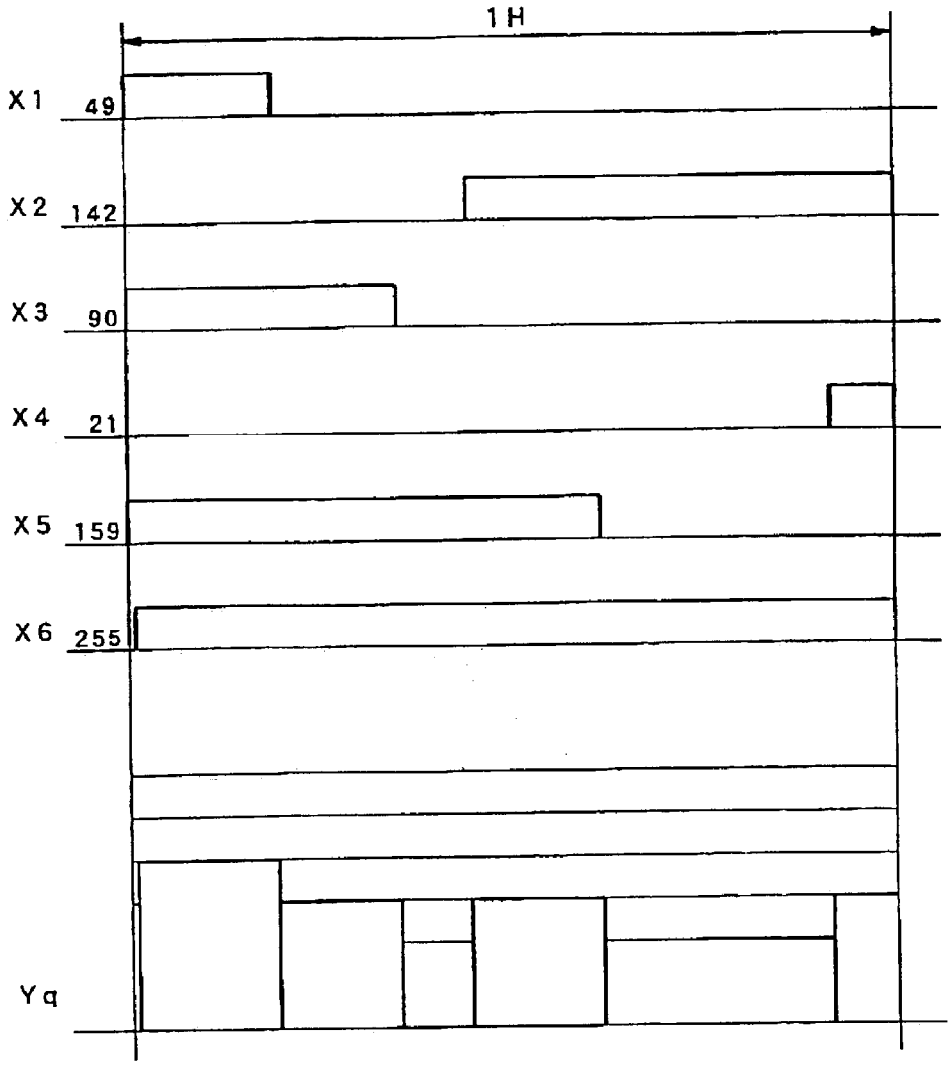
FIG. 25 is a waveform diagram showing drive waveforms in the conventional PWM circuit along with the waveform of a current flowing in a row wiring.

FIG. 25 shows, as a comparative example, modulation signal drive waveforms produced by conventional pulse width modulation methods. Additionally FIG. 26 shows modulation signal drive waveforms in accordance with this embodiment.

In the pulse width modulation shown in FIG. 25, those drive waveforms for odd-numbered columns are simply aligned so that they rise up in unison at the start time point of a one horizontal scanning time period (1H), whereas the drive waveforms for even-numbered columns are designed to fall down together at the finish time of 1H. It can be seen from viewing the waveform diagram that this method is advantageous over standard pulse width modulation techniques in that the former offers certain capability to average currents flowing in a row wiring Yq and reduce the voltage drop amount. But a range of current variation remains large when looking at the entirety of 1H.

Figure 26:
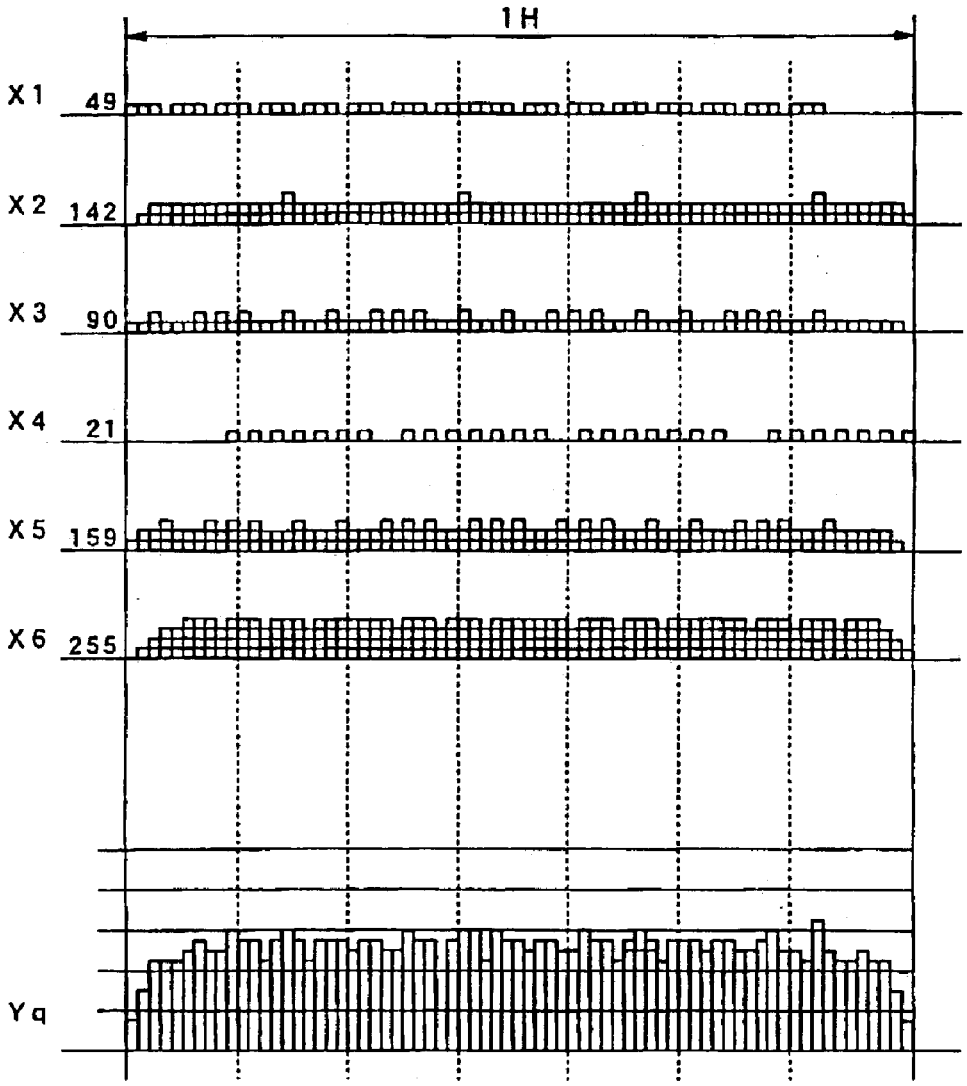
FIG. 26 is a waveform diagram showing drive waveforms in the PWM circuit of the second embodiment along with the waveform of a current flowing in a row wiring.

On the other hand, the example shown in FIG. 26 is the one that uses in combination the "1-slot offset" technique for the dispersed pulses in accordance with this embodiment. It can be seen that when compared to the drive Waveforms of FIG. 25, the current flowing in the row wiring Yq is less in waveform variation width and is well averaged over the entirety of 1H.

It should be noted that although this embodiment is arranged to employ the "1-slot offset" method for causing the pulse layout to be offset by a one slot between the odd-numbered and even-numbered columns, the scope of the invention should not exclusively be limited there to and may be modified and altered in a variety of forms.

For instance, control may be done so that the rise-up of a drive waveform being applied to a column wiring of an odd-numbered column comes after a start td time (any given time) of 1H while performing control so that the riseup of a drive waveform being applied to an even-numbered column wiring is more than td time plus one slot from the start of 1H. Alternatively, similar results are also obtainable by using a control scheme for causing the riseup of a drive waveform being applied to a column wiring which belongs to the n+1th group (where n is an integer greater than or equal to 1) is more than td time+(n−1) slots from the start of 1H.

(Other Modifications)

Although in the first embodiment the potential levels of respective drive voltages V1, V2, V3 and V4 are designed so that the luminescence intensity ratio is 1:2:3:4, these may be modified so that effective parts of the potential levels of respective drive voltages V1, V2, V3 and V4 are equally divided ones.

Figure 27:
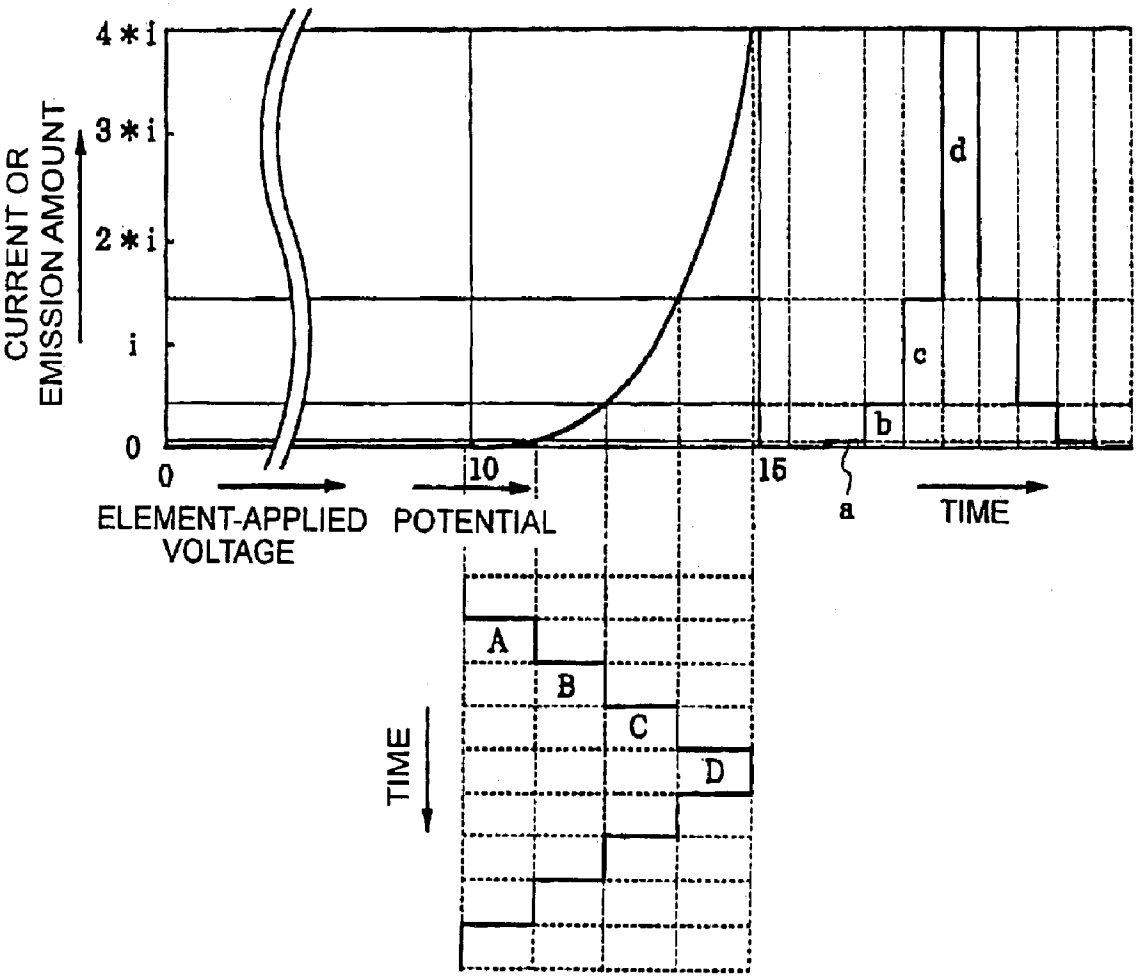
FIG. 27 is a graph showing emitting element voltage versus luminescence intensity characteristics (voltage equidivision)

In order to prevent ringing and overshoot occurring at the rising and falling edges of a waveform, it is effective to equalize voltages between the potentials V1, V2, V3, V4, (V0) that a potential difference relative to the base potential becomes the drive voltage threshold value of an element. FIG. 27 shows a relationship of an applied voltage versus light emission amount in case the effective part of a drive potential amplitude is equally divided. It can be seen that the light emission amount of unit drive waveform blocks A, B, C, D each of which is constituted from the unit pulse width and unit peak value as indicated in the with-time drive waveform change graph are kept unequal.

Although in each of the above-stated embodiments one specific example is shown for performing four-level peak value control with 256 shades of gray of from 0 to 255 gradation levels, the applicability of this invention should not be limited thereto. The invention may preferably be applied to other control systems employing peak value control schemes with less than or more than four levels or, alternatively, control systems with the tonality of less than 256 or greater than 256 gradation levels.

Additionally the pulse dispersion rules used in the embodiments are illustrative examples and may be replaced with a variety of other dispersion rules when the invention is reduced to practice. Note that the primary objective of dispersing unit pulses is to scatter a current flowing in a row wiring. To attain this object, a technique is employable for eliminating the state that all the unit pulses disproportionately appear at part of the effective light emission time period (net drive time) of the row wiring and for forcing the unit pulses to appear in a uniformly scattered pattern at substantially the same density over the entirety of the effective emission time period. Accordingly, several approaches are available, one of which is to generate the unit pulses in conformity with certain rules as in the embodiments above, and another of which is to produce the unit pulses at randomized timings.

It has been stated that according to the present invention, it is possible to accurately drive image display elements in accordance with luminance data as input thereto to thereby enable achievement of high-quality/high-fidelity video image displaying capabilities.

What is claimed is:

1. A modulator, comprising:

a modulation circuit for generating modulation signals based on inputted luminance data and for outputting the modulation signals to a plurality of image display elements, each of which is driven by a potential difference between a selection potential applied within a predetermined time period by a selection circuit and the modulation signal, wherein the image display elements are matrix-wired by a plurality of row wirings and a plurality of column wirings, the selection circuit selects the row wiring for the predetermined time period by line sequential scan, and one modulation signal is outputted to one of the column wirings in the predetermined time, the modulation signal has a waveform which is a combination of a plurality of unit pulses, the unit pulses having an identical width and n kinds of peak values A1 to An, with n being an integer greater than 1, and A1<. . . <An, and the unit pulses are combined in such a way that the plurality of unit pulses forming the waveform are continuously arranged without an interval, that maximal peak value portions of the waveform of the modulation signal are dispersed, and that a rising portion and a falling portion of the waveform have a stair-step-like shape.

2. A modulator according to claim 1, wherein the unit pulses are combined in such a way that a unit pulse with either peak value Ak or Ak−1 comes in front of a unit pulse with peak value Ak, with k being an integer greater than 1 and less than or equal to n.

3. A modulator according to claim 1, wherein the image display element is an electron emitting element.

4. An image display apparatus comprising:

an image display unit having a plurality of image display elements matrix-wired by a plurality of row wirings and a plurality of column wirings;

a selection circuit to output within a predetermined time period a selection potential to a row wiring to which image display elements to be driven are connected; and a modulation circuit to generate modulation signals based on inputted luminance data and to output the modulation signals to the column wirings respectively, wherein the selection circuit selects the row wiring for the predetermined time period by line sequential scan, and one modulation signal is outputted to one of the column wirings in the predetermined time, the modulation signal has a waveform which is a combination of a plurality of unit pulses, the unit pulses having an identical width and n kinds of peak values A1 to An, with n being an integer greater than 1, and A1<. . . <An, and the unit pulses are combined in such a way that the plurality of unit pulses forming the waveform are continuously arranged without an interval, that maximal peak value portions of the waveform of the modulation signal are dispersed, and that a rising portion and a falling portion of the waveform have a stair-step-like shape.

* * * * *

UNITED STATES PATENT AND TRADEMARK OFFICE

CERTIFICATE OF CORRECTION

PATENT NO. : 7,142,178 B2
APPLICATION NO. : 10/459434
DATED : November 28, 2006
INVENTOR(S) : Tadashi Aoki It is certified that error appears in the above-identified patent and that said Letters Patent is hereby corrected as shown below:

On the title page, [*] Notice
[*] delete 319 days, and insert 264 days.

Signed and Sealed this

Twenty-sixth Day of June, 2007

JON W. DUDAS
*Director of the United States Patent and Trademark Office*